US011340051B2

(12) United States Patent
Hand

(10) Patent No.: US 11,340,051 B2
(45) Date of Patent: May 24, 2022

(54) BALLISTIC ARROW AND COMPONENTS

(71) Applicant: William David Hand, Houston, TX (US)

(72) Inventor: William David Hand, Houston, TX (US)

( * ) Notice: Subject to any disclaimer, the term of this patent is extended or adjusted under 35 U.S.C. 154(b) by 0 days.

(21) Appl. No.: 16/797,358

(22) Filed: Feb. 21, 2020

(65) Prior Publication Data

US 2020/0271428 A1 Aug. 27, 2020

Related U.S. Application Data

(63) Continuation of application No. 15/828,619, filed on Dec. 1, 2017, now Pat. No. 10,571,233, which is a continuation of application No. 15/263,913, filed on Sep. 13, 2016, now Pat. No. 9,835,424, which is a continuation of application No. 14/201,182, filed on Mar. 7, 2014, now Pat. No. 9,470,487, and a continuation-in-part of application No. 13/858,160, filed on Apr. 8, 2013, now Pat. No. 8,764,591, which is a continuation of application No. 13/536,033, filed on Jun. 28, 2012, now Pat. No. 8,771,111, and a continuation-in-part of application No. 13/536,033, filed on Jun. 28, 2012, now Pat. No. 8,771,111, and a continuation-in-part of application No. 13/536,349, filed on Jun. 28, 2012, now Pat. No. 8,414,432, which is a continuation of application No. 13/536,349, filed on Jun. 25, 2012, now Pat. No. 8,414,432.

(60) Provisional application No. 61/921,570, filed on Dec. 30, 2013, provisional application No. 61/810,530, filed on Apr. 10, 2013.

(51) Int. Cl.
*F42B 6/08* (2006.01)
*F42B 6/04* (2006.01)

(52) U.S. Cl.
CPC . *F42B 6/08* (2013.01); *F42B 6/04* (2013.01)

(58) Field of Classification Search
CPC ..... F42B 6/04; F42B 6/08
See application file for complete search history.

(56) References Cited

U.S. PATENT DOCUMENTS 2,589,137 A * 3/1952 Ramsey ..... F42B 6/08 473/583
2,676,017 A * 4/1954 Selent ..... F42B 6/08 473/583
2,873,334 A * 2/1959 Wirsching ..... H01H 13/62 200/523
2,874,968 A * 2/1959 Zielinski ..... F42B 6/08 473/583

(Continued)

*Primary Examiner* — John A Ricci
(74) *Attorney, Agent, or Firm* — McAughan Deaver PLLC

(57) ABSTRACT

A hunting arrow having an arrow shaft with a front end and a back end. The hunting arrow has at least one arrow blade attached to the arrow shaft, and has a closed position and at least one open position. The at least one arrow blade is substantially flush with the arrow shaft when in the closed position, and extends radially outward from the arrow shaft when in an open position. In addition, the hunting arrow has an arrow tip that is attached to the front end of the arrow shaft and is capable of moving longitudinally toward or away from the arrow shaft. The arrow tip is operatively engaged with the at least one arrow blade so that the arrow tip opens and closes the at least one arrow blade by moving relative to the arrow shaft.

20 Claims, 24 Drawing Sheets

(56) References Cited

U.S. PATENT DOCUMENTS 3,759,519 A * 9/1973 Palma ..... F42B 12/362 473/578
4,037,839 A * 7/1977 Nelson ..... F41B 15/027 463/47.7
4,166,619 A * 9/1979 Bergmann ..... F42B 12/362 30/161
4,210,330 A * 7/1980 Kosbab ..... F42B 6/08 473/584
4,579,348 A * 4/1986 Jones ..... F42B 6/08 473/583
4,976,443 A * 12/1990 DeLucia ..... F42B 6/08 473/583
4,998,738 A * 3/1991 Puckett ..... F42B 6/08 473/583
5,066,021 A * 11/1991 DeLucia ..... F42B 6/08 473/583
5,082,292 A * 1/1992 Puckett ..... F42B 6/08 473/583
5,096,205 A * 3/1992 Dudley ..... F42B 6/04 473/577
5,458,341 A * 10/1995 Forrest ..... F42B 6/08 473/583
5,496,043 A * 3/1996 Ester ..... F42B 6/08 473/584
6,077,180 A * 6/2000 Adams, Jr. ..... F42B 6/08 473/584
6,863,630 B1 * 3/2005 Watkins ..... F42B 6/08 473/583
7,226,375 B1 * 6/2007 Sanford ..... F42B 6/08 473/583
7,491,126 B2 * 2/2009 Jung ..... F41B 15/025 135/75
7,713,151 B2 * 5/2010 Fulton ..... F42B 6/08 473/583
7,713,152 B1 * 5/2010 Tentler ..... F42B 6/08 473/583
7,717,814 B1 * 5/2010 Sanford ..... F42B 6/08 473/583
8,043,178 B2 * 10/2011 Sarnes ..... F42B 6/08 473/583
8,079,926 B2 * 12/2011 Mackey, Jr. ..... F42B 6/04 473/586
8,167,748 B2 * 5/2012 Butcher ..... F42B 6/08 473/583
8,414,432 B1 * 4/2013 Hand ..... F42B 6/04 473/583
9,470,487 B2 * 10/2016 Hand ..... F42B 6/08
9,835,424 B2 * 12/2017 Hand ..... F42B 6/08
2009/0203477 A1 * 8/2009 Mizek ..... F42B 6/08 473/583
2012/0068036 A1 * 3/2012 Cerezo Lotina ..... E04G 21/26 248/354.1
2014/0256482 A1 * 9/2014 Hartman ..... F42B 6/04 473/578

* cited by examiner

BALLISTIC ARROW AND COMPONENTS

CROSS-REFERENCES TO RELATED APPLICATIONS

This application is a continuation of U.S. patent application 15,828,619, filed Dec. 1, 2017, now U.S. Pat. No. 10,571,233, which is a continuation of U.S. patent application Ser. No. 15/263,913, filed Sep. 13, 2016, now U.S. Pat. No. 9,835,424, which is a continuation of U.S. patent application Ser. No. 14/201,182, filed Mar. 7, 2014, now U.S. Pat. No. 9,470,487, which is a continuation-in-part of U.S. patent application Ser. No. 13/536,033, filed Jun. 28, 2012, now U.S. Pat. No. 8,771,111 and U.S. patent application Ser. No. 13/858,160, filed Apr. 8, 2013, now U.S. Pat. No. 8,764,591, which is a continuation of U.S. patent application Ser. No. 13/536,349, filed Jun. 28,2012, now U.S. Pat. No. 8,414,432 and a continuation of U.S. patent application Ser. No. 13/536,033, filed Jun. 28, 2012. The present application claims priority to provisional application 61/810,530 filed Apr. 10, 2013, and provisional application 61/921,570, filed Dec. 30, 2013. The contents of the aforementioned applications are incorporated herein by reference in their entirety for all purposes.

FIELD OF THE INVENTION

The present invention relates generally to arrows used for hunting. In particular, the invention relates to (a) hunting arrows having blades that deploy, or that separate into multiple parts, upon impact with a target; and (b) hunting devices that extend the arrow shaft to have blades that deploy from the shaft; and (c) hunting devices that have blades incorporated in, and deployed from, the shaft.

BACKGROUND OF THE INVENTION

Conventional arrows rely primarily on the arrow tip to cut into a target, penetrate it, and exit it, with no consideration that the arrow or arrows themselves can be integral cutting devices. These conventional arrows generally include an arrow shaft having interchangeable arrow heads. Generally, arrow head designs have been limited to small broad heads designed for improved flight, and a one size cutting angle and resulting cutting diameter of the tip. If it is a mechanical device, it often will rely on its ability to open in a relatively short timeframe because the blades are located close to the initial point of contact of the target. Moreover, relative densities at the point of impact can vary greatly (e.g., initial contact with an animal can strike soft tissue or dense bone). Conventional designs typically fall short in accounting for these considerations which can, as a result, affect their reliability. The impact surface further affects the ability of the mechanical blades and related mechanisms to deploy efficiently. With this loss of efficiency, the mechanical tip of a conventional arrowhead can absorb a disproportionate amount of kinetic energy which otherwise could have been transferred to the target. Additionally, it is difficult to design a tip that opens inside the target to most effectively damage vital organs.

Being confined to a tip, conventional designs are limited by their overall weight and length due to various competing design considerations. For example, because the tip of an arrow is located at the front of an arrow, it must be located forward of the arrow rest and the bow handle and, therefore, it is desirable to keep the weight of the arrowhead relatively low, and the length of the arrowhead, relatively short.

Because of these constraints, the arrowhead design must include relatively short blades so that the arrow's flight path and speed is not adversely affected. As such, conventional arrowheads are limited in length and weight thus precluding them from enclosing large blades that are needed for high-speed bow and cross bows, and further limiting their options for properly spacing a combination of a fixed-type design with a mechanical-type design. Finally, conventional tips are often limited to a single type of a device and cannot accommodate the weight necessary to accommodate a totally integrated solution.

Further, there has been little design variation, even with the development of modern high speed and compound bows, spear guns, and cross bows. Existing designs do not provide the ability for the archer to adjust the blade angle on the arrow heads to compensate for variable for bow poundage, or for specific target game. In addition, most current arrow head designs do not provide for a change of blade angles at the time of target penetration to optimize arrow performance for target having different densities.

Additionally, the safety of drawing an arrow and firing an arrow has not been addressed to protect the archer's hand and arm. Conventional arrow rests have been one dimensional only, holding the arrow at one point of time and place. The critical space between the string and bow handle, commonly called the "brace height," is left open by conventional arrow rests so that the archer is unprotected in that space. Moreover, conventional known arrow heads generally have blades that are fixed in open positions, and lack a safety locking system in place to constrain the blades in a closed position during the draw and fire cycle.

Modern bows, spear guns and crossbows today have reached levels of speed and kinetic energy that were not available years ago. The kinetic energy of the arrow in flight has almost doubled. Many modern arrows are designed to enable "pass through" shots, where the arrow completely passes quickly through the target. Because the arrow continues moving through and beyond the target, the arrow does not deliver 100% of its kinetic energy to the target. Any kinetic energy not delivered to the target is wasted.

Accordingly, it would be desirable to have a hunting arrow that deploys maximum kinetic energy on the target. Such a design could include a device that delivers the ballistics of first fracturing the surface of a target and secondary devices that open internal to the target or at some distance from impact within the target.

Moreover, such a design may include an arrow that deploys the proper number of blades at the proper blade angle, or that deploys multiple blades based on the density of the target at the point of impact. Such a design may also include a safety system that locks deployable blades or multiple arrow shafts into place during the draw and fire cycle, as well as an arrow rest and/or bow bracket that protects the arm and hand of an archer during the draw and fire cycle.

SUMMARY OF THE INVENTION

The invention can be embodied in a hunting arrow that includes an arrow shaft having a front end and a back end, and at least one arrow blade attached to the arrow shaft and having a closed position and at least one open position, wherein the at least one arrow blade is substantially flush with the arrow shaft when in the closed position, and extends radially outward from the arrow shaft when in an open position. The arrow also includes an arrow tip attached to the front end of the arrow shaft and capable of moving longitudinally toward or away from the arrow shaft, wherein the arrow tip is operatively engaged with the at least one arrow blade so that movement of the arrow tip relative to the arrow shaft opens and closes the at least one arrow blade.

The invention can be further represented in a hunting arrow that includes an arrow shaft divided into two substantially equal halves about a longitudinal plane of the arrow shaft, wherein the two substantially equal halves are releasably connected, and at least one trigger blade attached to at least one of the arrow shaft halves and configured to pivot in a direction perpendicular to the longitudinal plane about which the shaft is divided, the at least one trigger blade having a target contacting end and an opposing shaft contacting end. Preferably, the at least one trigger blade is arranged and designed so that when the target contacting end comes into contact with a target, the trigger blade pivots so that the opposing shaft contacting end comes into contact with and exerts a force on the arrow shaft half to which it is not attached, thereby separating the shaft halves.

A further representation of the invention can be found in a hunting arrow assembly that includes a coupler configured to hold at least two separate arrows so that the two separate arrows are releasably connected, and at least one trigger blade attached to at least one of the arrows and configured to pivot around its point of attachment to the arrow, the at least one trigger blade having a target contacting end and an opposing arrow contacting end. Preferably, the at least one trigger blade is arranged and designed so that when the target contacting end comes into contact with a target, the trigger blade pivots so that the opposing arrow contacting end comes into contact with and exerts a force on the arrow that is held by the coupler and to which the at least one trigger blade is not attached, thereby separating at least one of the arrows from the coupler.

The invention can be further represented in a telescoping arrow for hunting that includes an arrow shaft having an inner shaft portion and an outer shaft portion having a front end, the inner shaft portion substantially radially surrounded by the outer shaft portion and configured to move relative to the outer shaft portion in a longitudinal direction, and a spring attached to the inner shaft portion and to the outer shaft portion, the spring arranged and designed so that in its neutral position the inner shaft portion extends at least partially out of the front end of the outer shaft portion. The telescoping arrow also includes means for maintaining the relative position of the inner and outer shaft portions so that the inner shaft portion is positioned substantially within the outer shaft portion and the spring is compressed between the inner and outer shaft portions, the spring exerting a force on the inner shaft portion toward the front end of the outer shaft portion. Preferably, further compression of the inner shaft portion relative to the outer shaft portion releases the means for maintaining the relative positions of the shaft portions so that the spring pushes the inner shaft portion at least partially out the front end of the outer shaft portion.

In addition, the invention can be further represented by a hunting arrow having a hollow arrow shaft defining an interior space and having a front shaft section and a separable back shaft section, wherein the front and back shaft sections are releasably connected, and at least one shaft separation protrusion attached to each of the front shaft section and the back shaft section, the shaft separation protrusions positioned adjacent one another and substantially blocking the interior space with the arrow shaft. The arrow also has an arrow tip attached to the front end of the front shaft section and capable of moving longitudinally toward or away from the front shaft section, and a cam positioned within the interior space within the front shaft section and attached to the arrow tip so that the movements of the cam relative to the arrow shaft correspond to the movements of the arrow tip relative to the front shaft section. Thus, when the arrow tip is compressed relative to the front shaft section, the cam moves toward the back shaft section and pushes against the shaft separation protrusions, thereby forcing the shaft separation protrusions apart and separating the front shaft section from the back shaft section.

Additionally, the invention can be further embodied in a hunting arrow having a back end and a front end, the front end can include an insert coupling device to attach to an extended shaft. The extended shaft can include at least one arrow blade coupled to the shaft such that the at least one arrow blade can be in a closed position and at least one open position. When in the closed position, the at least one arrow blade can be flush or substantially flush with a vertical tab trigger blade section. For example, the at least one arrow blade can be flush-mounted in the extended shaft so as to not impede flight and could have small vertical extensions or tabs to help in deployment. The extensions or tabs can further add support and stability to the at least one arrow blade when in the open position. Moreover, the tabs can be used to prevent the arrow shaft from being drawn back too far (e.g., such that the tabs can prevent movement beyond the arrow rest on a bow as an archer draws the arrow back before shooting). Furthermore, when in the open position, the at least one arrow blade can extend outwardly from the extended shaft.

Blades internal to the shaft could also be held by a cartridge that can include a rear-angled contacting surface that can assist in opening the blades and setting the proper angle. Additionally, the blades can include one or more slots so that they can slide from a closed position to an opened position and vice-a-versa. The extended shaft can further include a fixed arrow tip broad head and/or channeled broad head with a sliding tip moving longitudinally toward or away from the arrow shaft wherein the adjustable sliding tip and connecting push rod can be operably engaged with the at least one arrow blade so that movement of the sliding tip and the connecting rod opens and closes the at least one arrow blade.

By having both a properly sized cutting tip and enclosed blades in the extended shaft that mechanically open, the design could exploit the extended shaft's deceleration and loss of momentum upon impact with its target to assist in the opening of a secondary blade internal to the extended shaft. The combination of these devices along the extended arrow shaft could allow for the proper calibration (e.g., based on the blade size, angle, and deployment timing, etc.) of the optimum delivery of kinetic energy at particular distance, for a given target.

BRIEF DESCRIPTION OF THE DRAWINGS

The invention will be more fully understood by reference to the detailed description of the invention below, and by examining the following drawing in which.

DETAILED DESCRIPTION OF THE INVENTION

Figure 1A:
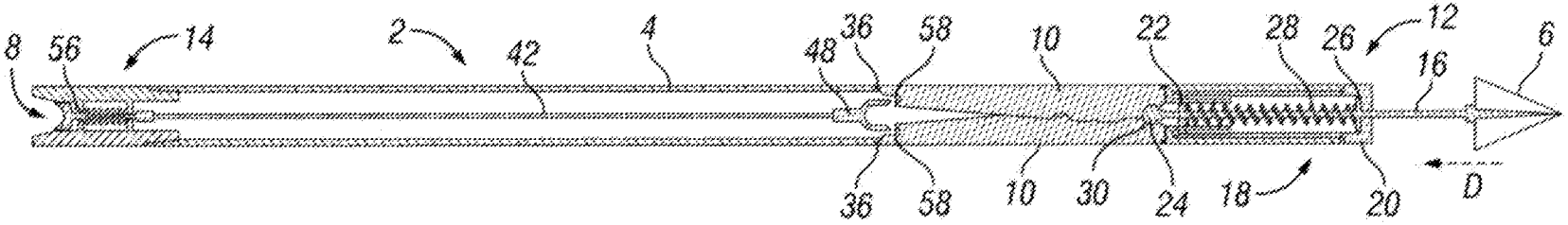
FIG. 1A is a cross-sectional view of an arrow according to one embodiment of the present invention having arrow blades in the arrow shaft.

The foregoing aspects, features, and advantages of the present invention will be further appreciated when considered with reference to the following description of preferred embodiments and accompanying drawings, wherein like reference numerals represent like elements. In describing embodiments of the invention illustrated in the appended drawings, specific terminology will be used for the sake of clarity. However, the invention is not intended to be limited to the specific terms used, and it is to be understood that each specific term may include equivalents that operate in a similar manner to accomplish a similar purpose.

In accordance with the present invention, there is provided a hunting arrow. The hunting arrow may preferably include parts common to known arrows, such as, for example, arrow vanes. For purposes of simplicity, however, all such features are not shown in the drawings. Multiple arrows are represented in the appended drawings. For example, the invention includes an arrow that encloses deployable blades or sharp wires for hunting. Also provided is an arrow or arrows that separate at impact, or divide into parts. Also provided is an arrow that encloses a smaller arrow or arrow shaft to deploy blades. Furthermore, an integral safety system is disclosed that both locks the blades in place when the arrow is nocked, and/or controls the force required to open the blades at various angles. Additionally, a safety tube or cylinder is disclosed that is attached to the bow. The safety tube provides a passage for the arrow to pass through when shot, to protect the archer's arm and hand by providing a physical barrier between the arrow and the archer's arm and hand. FIG. 1A illustrates a hunting arrow 2 having an elongated shaft 4, a tip 6, and a nock 8.

Enclosed in the arrow 2 are elongated arrow blades 10, which can be located anywhere along the shaft 4 of the arrow 2 and which are designed to remain substantially flush with the arrow shaft 4 during loading and shooting of the arrow 2, and to deploy outwardly from the arrow shaft 4 upon impact with a target. The position of the arrow blades 10 (either flush with the shaft 4 or deployed) is controlled by an arrow tip assembly 12 and a nock locking assembly 14.

Figure 2:
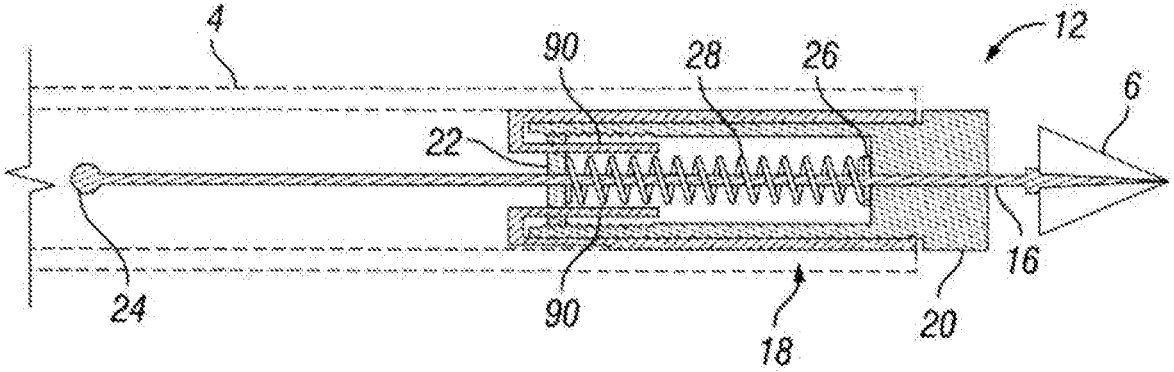
FIG. 2 is an enlarged cross-sectional view of an arrow tip assembly according to the one embodiment of the present invention.

The arrow tip assembly 12 is shown in FIG. 2, and includes the arrow tip 6, which may be a broad head arrow tip, attached to a tip shaft 16. The tip shaft 16 passes through a tension lock insert assembly 18 having a rotatable cylinder 20, and a cap 22. A cam 24 is attached to, and may be formed integrally with, the end of the tip shaft 16. The rotatable cylinder 20 is circumferentially rotatable about its axis, but is fixed relative to the arrow shaft 4 in a longitudinal direction. Furthermore, a tip shaft flange 26 is attached to the tip shaft 16 inside the rotatable cylinder 20, thereby preventing the tip shaft 16 from moving longitudinally away from the rotatable cylinder 20. The cap 22 is preferably in threaded engagement with the rotatable cylinder 20 so that when the rotatable cylinder 20 rotates circumferentially, the cap 22 moves longitudinally relative to the rotatable cylinder 20. The cap 22 is preferably constrained from rotating circumferentially by pins 90 connecting the cap 22 to the arrow shaft 4. The pins 90 may be extensions of the rotatable cylinder 20, as shown in FIG. 2. The tension lock insert assembly 18 also has a compression spring 28, or similar mechanism or material, positioned between the cap 22 and the flange 26 of the tip shaft 16. The spring 28 is biased to urge the flange 26 of the tip shaft 16 against the bottom of the rotatable cylinder 20, thereby maintaining the longitudinal position of the tip shaft 16 (and by extension the arrow tip 6 and cam 24) relative to the arrow shaft 4.

Figure 3A:
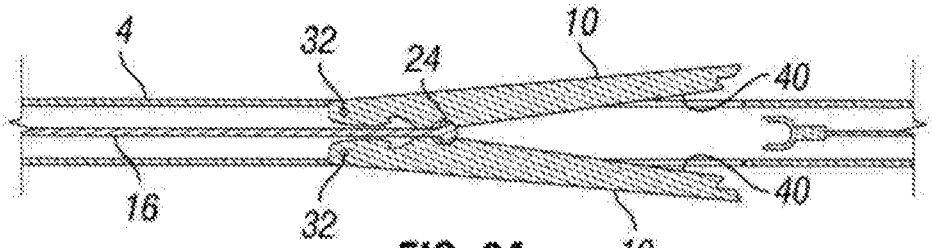
FIG. 3A is an enlarged cross-sectional view of the arrow blades according to one embodiment of the present invention, where the arrow blades are attached to the arrow shaft by two pins and are in an open position relative to the arrow shaft.
Figure 3B:
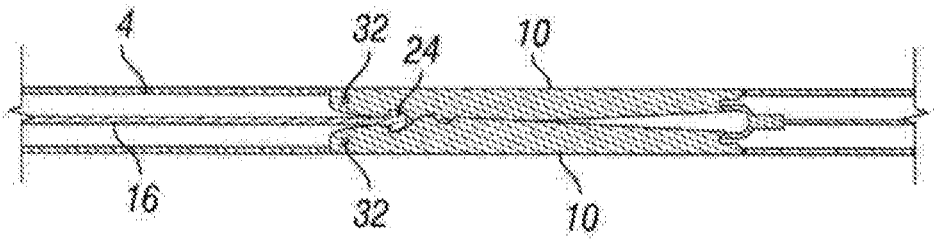
FIG. 3B is an enlarged cross-sectional view of the arrow blades according to one embodiment of the present invention, where the arrow blades are attached to the arrow shaft by two pins and are in a closed position relative to the arrow shaft.
Figure 4A:
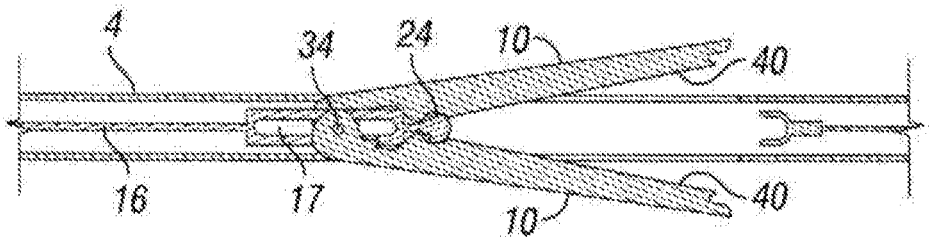
FIG. 4A is an enlarged cross-sectional view of the arrow blades according to one embodiment of the present invention, where the arrow blades are attached to the arrow shaft by one pin, and are in an open position relative to the arrow shaft.
Figure 4B:
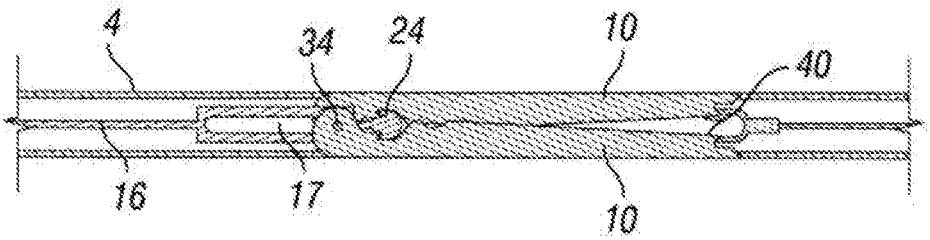
FIG. 4B is an enlarged cross-sectional view of the arrow blades according to one embodiment of the present invention, where the arrow blades are attached to the arrow shaft by one pin, and are in a closed position relative to the arrow shaft.

Referring back to FIGS. 1A-1D, the arrow blades 10 have notches 30 designed to accept the cam 24 at the end of the tip shaft 16. The notches 30 are shaped so that the blades 10 cannot rotate outwardly while engaged with the cam 24. Thus, the tension in the spring 28 maintains the position of the cam 24 relative to the arrow shaft 4, which in turn maintains the blades 10 in their closed position. In some embodiments, the cam 24 may have notches that engage with the arrow blades 10 to maintain the arrow blades 10 in their closed position relative to the arrow shaft 4. In one preferred embodiment, the blades are attached to the arrow shaft 4 with two pins 32 (as shown in FIGS. 3A and 3B). In another embodiment, the blades may be attached to the arrow shaft 4 with only one pin 34 (as shown in FIGS. 4A and 4B). Optionally, the arrow blades 10 may be held in place by an "o" ring 36, or by other means, such as plastic constraints or heat shrink wrap.

In practice, the arrow is fired at a target, such as, for example, an animal. When the arrow tip 6 impacts the target, the arrow tip is slowed by the impact, while the rest of the arrow continues forward, propelled by its own momentum. Thus, at the time of impact, the arrow tip 6 compresses inwardly toward the arrow shaft 4 in a direction D. As the arrow head compresses inwardly, the tip shaft 16 and attached cam 24 are pushed inward relative to the arrow shaft 4. The cam 24 disengages from the notches 30 of the arrow blades 10 and travels inwardly therebetween, thereby pushing the arrow blades radially outwardly from the sides of the arrow shaft 4, as shown in FIG. 1D. Preferably, the arrow blades 10 include a number of additional notches 38 located at different positions along the inside of the arrow blades 10 and configured to engage the cam 24 as it moves inwardly relative to the arrow shaft 4, thereby locking the arrow blades 10 in an open position.

The inner surfaces 40 of the arrow blades 10 are preferably tapered so that there is an inverse relationship between the distance that the cam 24 travels relative to the arrow blades 10, and the radial distance that the arrow blades 10 open from the sides of the arrow shaft 4. In other words, when the cam 24 is compressed only a short distance from notch 30, the arrow blades 10 open at a wide angle relative to the arrow shaft 4. Conversely, when the cam 24 is compressed a greater distance from notch 30, the arrow blades 10 open at a lesser angle. Accordingly, when the arrow tip 6 impacts a soft target, such as the flesh behind the shoulder of an animal, the arrow tip 6, and in turn the cam 24, is compressed only a short distance, thereby forcing the arrow blades 10 to open widely from the arrow shaft 4. However, when the arrow head impacts a hard target, such as the bone of an animal, the arrow tip 6, and in turn the cam 24, is compressed a longer distance relative to the arrow shaft 4, thereby opening the arrow blades 10 at a lesser angle.

Figure 1B:
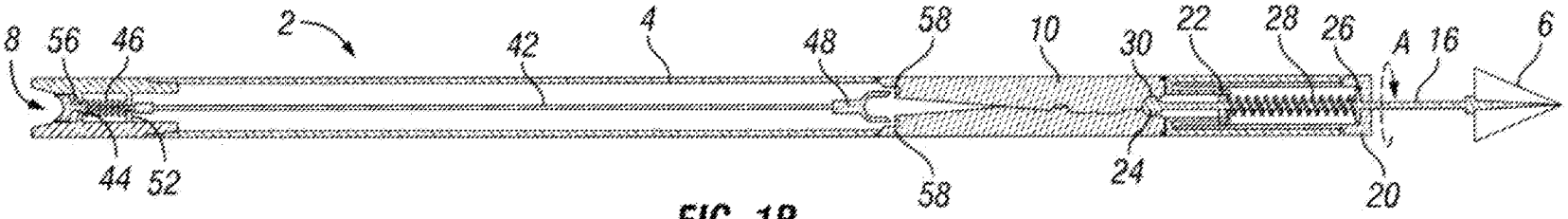
FIG. 1B is a cross-sectional view of the arrow shown in FIG. 1A, and showing how the tension of the arrow tip assembly can be adjusted.

As shown in FIG. 1B, the rotatable cylinder 20 can be rotated as indicated by arrow A, thereby adjusting the longitudinal position of the cap 22 relative to the rotatable cylinder 20. This change in position of the cap 22 increases or decreases the distance between the cap 22 and the flange 26 of the tip shaft 16, thereby compressing or decompressing the compression spring 28. As discussed above, the compression spring 28 is biased to maintain the arrow tip 6 in a predetermined position forward of the arrow shaft 4. As the spring is compressed by the cap 22, the biasing force on the flange 26 increases, thereby increasing the resistance of the arrow tip 6 to compression relative to the arrow shaft 4. As discussed above, the distance that the arrow tip 6 compresses relative to the arrow shaft 4 is proportional to the angle of the arrow blades 10 relative to the arrow shaft 4. Thus, rotation of the cylinder 20 allows for adjustment of the compressibility of the arrow tip 6 and the associated angle that the arrow blades 10 protrude from the arrow shaft 4 according to the desire of the archer.

Figure 1C:
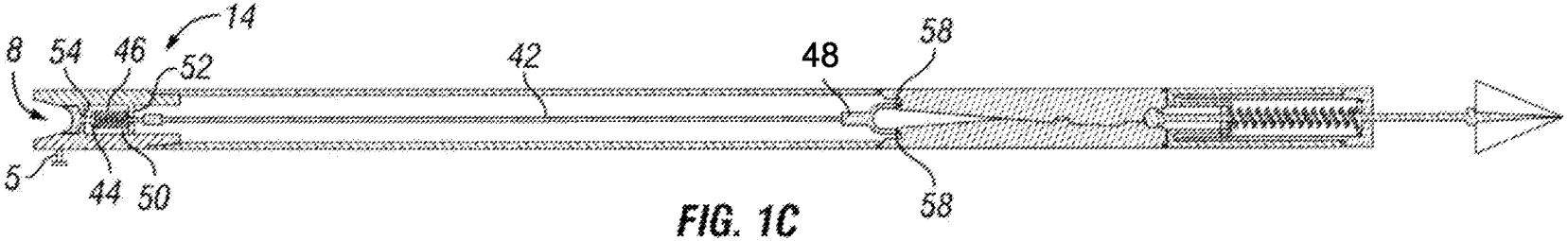
FIG. 1C is a cross-sectional view of the arrow of FIGS. 1A and 1B, and showing the blade locking mechanism of the nock locking assembly engaged with the arrow blades to maintain the arrow blades in their closed position.
Figure 1D:
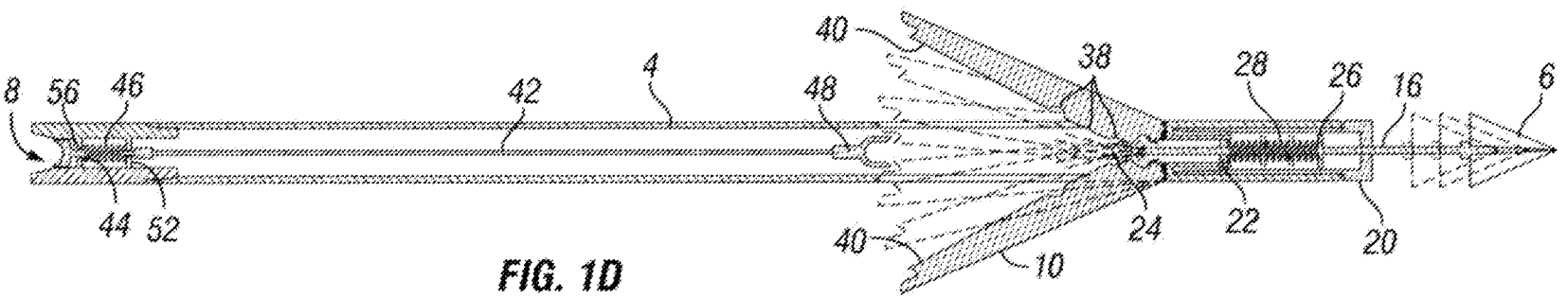
FIG. 1D is a cross-sectional view of the arrow of FIGS. 1A-1C, and showing the opening and closing of the arrow blades as the arrow tip moves inwardly and outwardly relative to the arrow shaft.

Referring in particular to FIG. 1C, there is shown the nock locking assembly 14 of the invention is a locked position. The nock locking assembly 14 includes a nock 8, a nock lock shaft 42 having a nock flange 44, a nock spring 46 (or other similar mechanism or material), and a blade locking mechanism 48. The nock spring 46 and the nock flange 44 are enclosed in a segregated opening 50 at the nock end of the arrow shaft 4. The segregated opening 50 is bounded by a first barrier 52 and the end 54 of the arrow shaft. The nock spring preferably engages the first barrier 52 and the nock flange 44, and the nock flange is positioned between the nock spring 46 and the end of the arrow shaft 54.

When the arrow 2 is disengaged from a bow string, the nock locking mechanism 14 is in an unlocked position, as shown in FIGS. 1A, 1B, and 1D. When in the unlocked position, the nock spring 46 is biased to urge the nock flange 44 into contact with the end 54 of the arrow shaft 4. With the nock flange 44 thus positioned, the nock 8 is disengaged from the end of the arrow shaft 4 and an opening 56 is disposed therebetween. The length of the nock lock shaft 42 is such that when the nock flange is in contact with the end 54 of the arrow shaft 4, the blade locking mechanism 48 does not impede the movement of the arrow blades 10 radially relative to the arrow shaft 4.

Upon engagement with a bow string, however, and as shown in FIG. 1C, the nock 8 is compressed into engagement with the end of the arrow shaft 4. The nock lock shaft 42, which is connected to the nock 8, as well as the nock flange 44 and the nock spring 46, are in turn compressed inwardly toward the arrow blades 10. This compression drives the blade locking mechanism 48 at the end of the nock lock shaft 42 into locked engagement with locking notches 58 on the arrow blades 10. Thus, the arrow blades 10 are constrained from opening while the arrow 2 is nocked in a bow string. Upon release of the arrow from the bowstring, the nock spring 46 again urges the nock flange 44 against the end 54 of the arrow shaft 4, thereby disengaging the blade locking mechanism 48 from the locking notches 58 on the arrow blades 10. The arrow blades 10 are then free to open when the arrow strikes a target, as discussed above.

In some embodiments, the nock locking assembly 14 may include a nock lock pin 5, as shown, for example, in FIG. 1C. The nock lock pin is arranged to lock the locking mechanism 48 with the locking notches 58 on the arrow blades 10 even when the arrow is not notched in a bowstring, thereby preventing the blades 10 from deploying during handling of the arrow. In addition, it is to be understood that the nock lock assembly may be employed in any of the arrows described herein to maintain deployable blades in a closed position or to maintain multiple parts of arrow shafts or multiple shafts in attached engagement. However, for the sake of simplicity, the nock locking assembly has not been shown in all of the figures.

FIGS. 3A and 3B show a close up view of the arrow blades 10 of the arrow of FIGS. 1A-1D, in which each arrow blade 10 is attached to the arrow shaft 4 with a separate pin 32. In this arrangement, the tip shaft 16 passes between the arrow blades 10 substantially along the center of the shaft 4. Pins 32 attach the arrow blades 10 to the shaft 4 at the sides of the shaft. Thus, as the cam 24 moves backward and forward relative to the inner surfaces 40 of the arrow blades 10, the arrow blades are free to pivot about the pins 32 without interfering with the backward and forward movement of the tip shaft 16.

FIGS. 4A and 4B, show an alternate arrangement for attaching the arrow blades 10 to the shaft 4. In this arrangement, both of the arrow blades 10 are attached to the arrow shaft 4 by a single pin 34 located at the center of the shaft. The tip shaft 16 accommodates the pin 34 by defining an elongate pin opening 17 through at least a portion of the tip shaft 16. The elongate pin opening 17 is positioned to accept the pin 34, thereby allowing the tip shaft 16 to move forward and backward around the pin 34, even though the tip shaft 16 is located substantially in the center of the arrow shaft 4. The opening 17 is at least long enough to allow the tip shaft 16 to move forward and backward as needed to push the cam 24 into opening and closing engagement with the inner surfaces 40 of the arrow blades 10. Thus, as the cam 24 moves backward and forward relative to the inner surfaces 40 of the arrow blades 10, the arrow blades are free to pivot about the pin 34 without interfering with the backward and forward movement of the tip shaft 16.

Figure 5A:
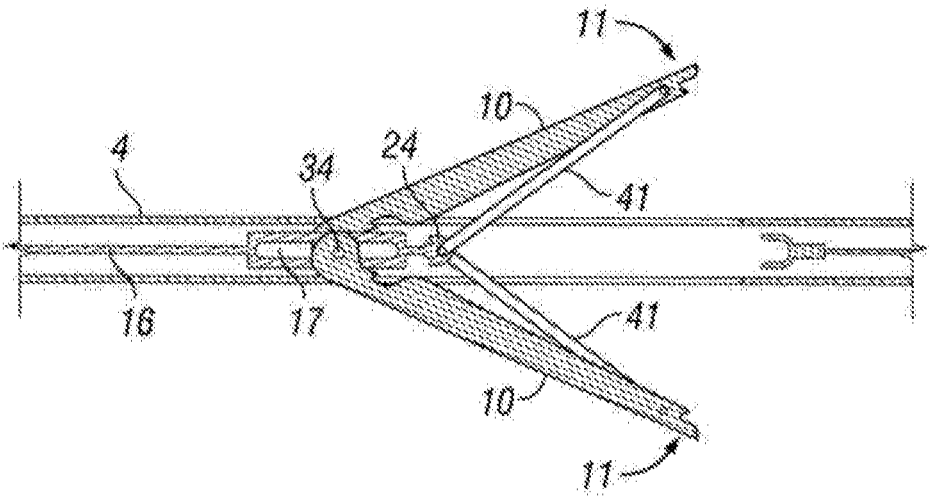
FIG. 5A is an enlarged cross-sectional view of the arrow blades according to one embodiment of the present invention, where the arrow blades are attached to the arrow shaft by one pin, are connected to the cam of the arrow tip assembly by a rod, and are in an open position relative to the arrow shaft.
Figure 5B:
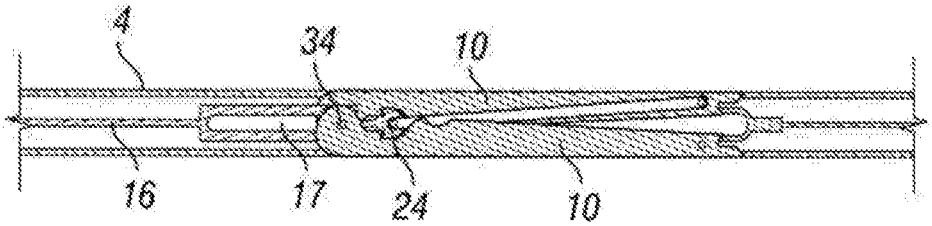
FIG. 5B is an enlarged cross-sectional view of the arrow blades according to one embodiment of the present invention, where the arrow blades are attached to the arrow shaft by one pin, are connected to the cam of the arrow tip assembly by a rod, and are in a closed position relative to the arrow shaft.

FIGS. 5A and 5B show another arrangement of the arrow blades 10. Similar to the arrow blades shown in FIGS. 4A and 4B, the arrow blades 10 of this arrangement pivot around a single pin 34. However, unlike the previously disclosed arrow blade arrangements, the arrow blades 10 of FIGS. 5A and 5B do not open and close by means of the cam 24 pushing on the inner surfaces of the blades 10. Instead, a rod 41 links the cam 24 to the back end 11 of each arrow blade 10. The rods 41 are arranged so that as the cam 24 moves toward the back of the arrow shaft 4, the arrow blades 10 are opened. Conversely, as the cam 24 moves toward the front of the arrow shaft 4, the arrow blades 10 close. Thus, unlike the arrangement shown in FIGS. 1A-1D, the radial distance that the arrow blades 10 open from the arrow shaft 4 is not inversely proportional to the amount that the arrow tip 6 compresses relative to the arrow shaft 4. Accordingly, when the arrow tip 6 impacts a soft target, the arrow tip 6, and in turn the cam 24, is compressed only a short distance, thereby opening the arrow blades 10 only a short distance from the arrow shaft 4. However, when the arrow head impacts a hard target, such as the bone of an animal, the arrow tip 6, and in turn the cam 24, is compressed a longer distance relative to the arrow shaft 4, thereby opening the arrow blades 10 a greater distance.

Figure 6A:
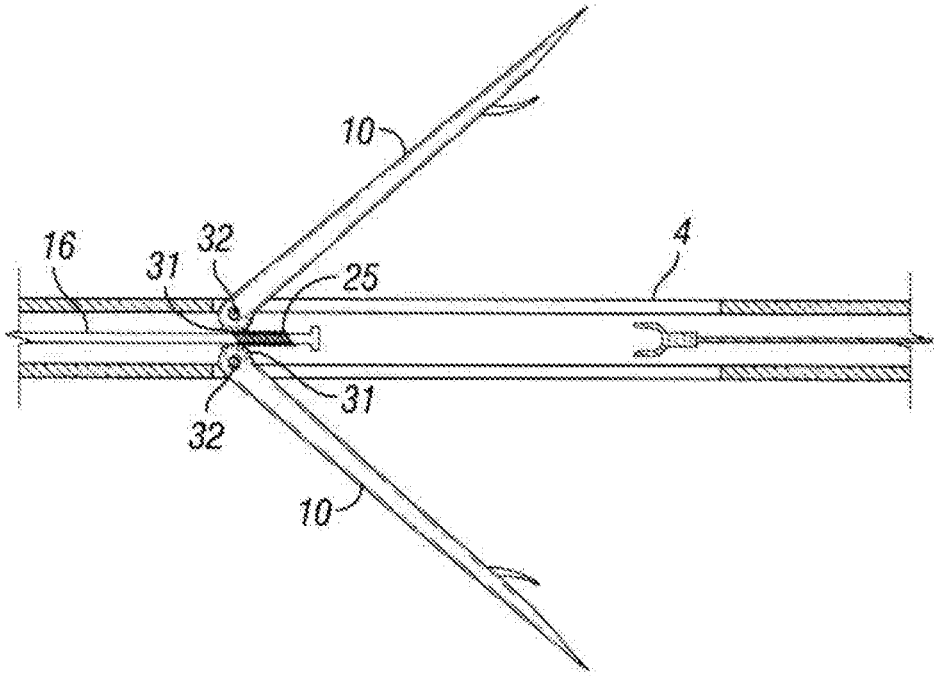
FIG. 6A is an enlarged cross-sectional view of the arrow blades according to one embodiment of the present invention, where the arrow blades are attached to the arrow shaft by two pins, are in an open position, and are opened and closed by means of a worm gear attached to the end of the tip shaft of the arrow tip assembly.
Figure 6B:
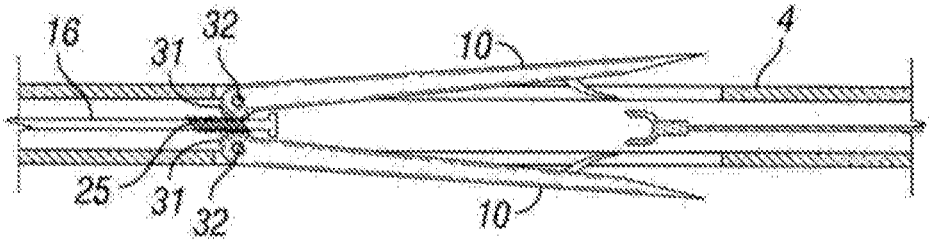
FIG. 6B is an enlarged cross-sectional view of the arrow blades according to one embodiment of the present invention, where the arrow blades are attached to the arrow shaft by two pins, are in an partially open, or intermediate position, and are opened and closed by means of a woilli gear attached to the end of the tip shaft of the arrow tip assembly.
Figure 6C:
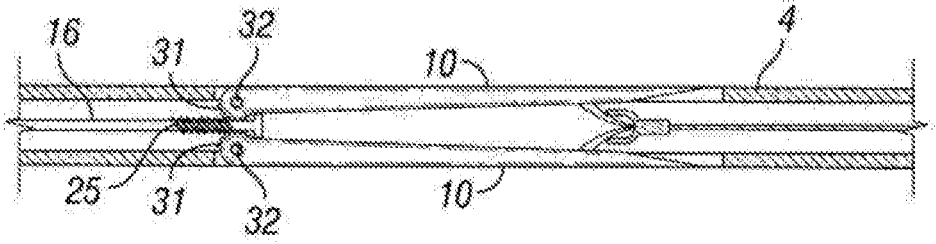
FIG. 6C is an enlarged cross-sectional view of the arrow blades according to one embodiment of the present invention, where the arrow blades are attached to the arrow shaft by two pins, are in a closed position, and are opened and closed by means of a worm gear attached to the end of the tip shaft of the arrow tip assembly.

FIGS. 6A-6C show yet another possible arrangement of the arrow blades 10 relative to the arrow shaft 4. In this arrangement, the arrow blades 10 are separately attached to the arrow shaft 4, preferably are directly or via an arrow shaft flange, by pins 32. In addition, the tip shaft 16 is not attached to a cam, but is instead attached to a threaded end 25, or a worm gear. The threads of the threaded end 25 are configured to correspond to threads 31 at the base of each arrow blade 10. As the tip shaft 16 moves toward the back of the arrow shaft 4, the threads of the threaded end 25 of the tip shaft 16 engage the threads 31 of the arrow blades 31, thereby pushing the arrow blades 10 into an open position. Conversely, as the tip shaft 16 moves toward the front of the arrow shaft 4, the threads of the threaded end 25 of the tip shaft 16 engage with the threads 31 of the arrow blades 10 to push the arrow blades 10 toward a closed position.

Figure 7A:
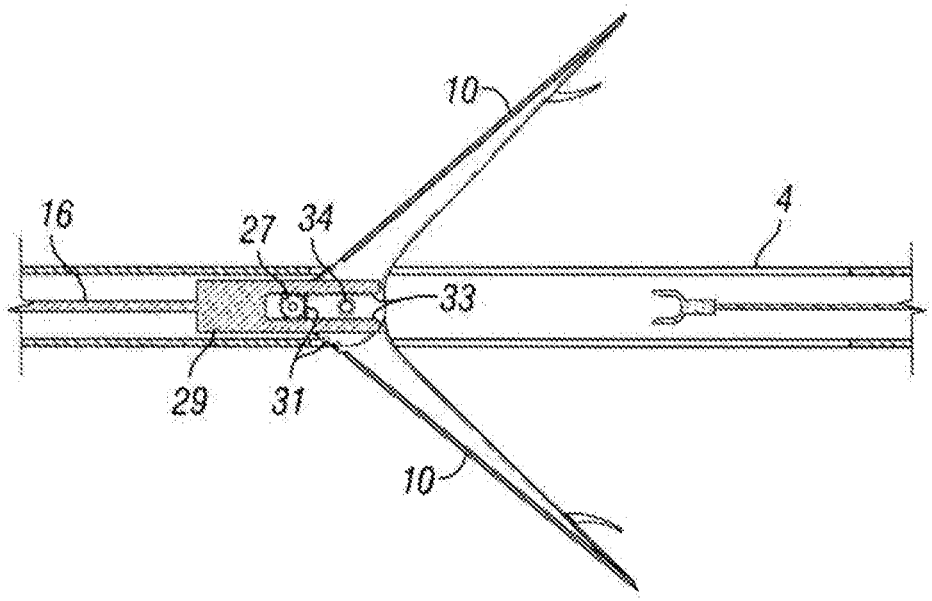
FIG. 7A is an enlarged cross-sectional view of the arrow blades according to one embodiment of the present invention, where the arrow blades are attached to the arrow shaft by one pin, are in an open position, and are opened and closed by means of a stationary gear that engages the threads on each of the arrow blades simultaneously.
Figure 7B:
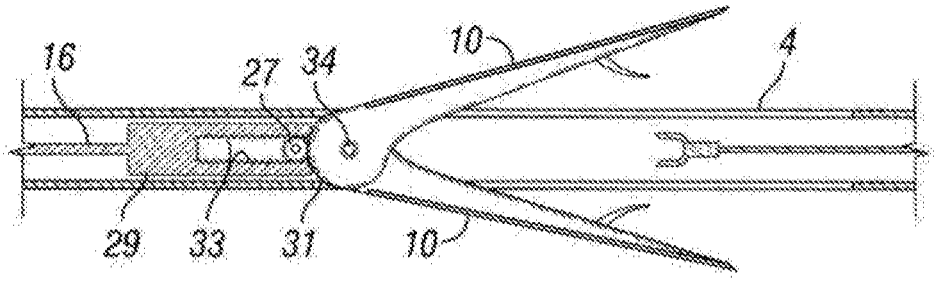
FIG. 7B is an enlarged cross-sectional view of the arrow blades according to one embodiment of the present invention, where the arrow blades are attached to the arrow shaft by one pin, are in a partially open, or intermediate position, and are opened and closed by means of a stationary gear that engages the threads on each of the arrow blades simultaneously.
Figure 7C:
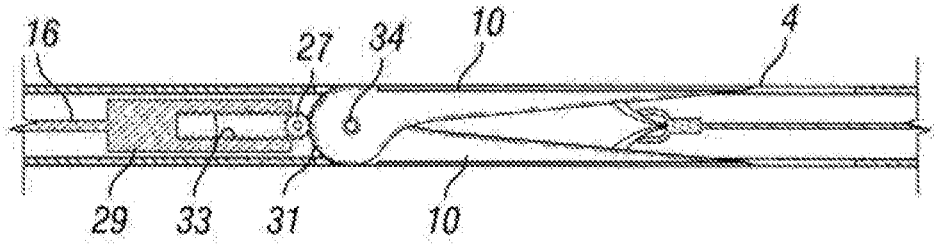
FIG. 7C is an enlarged cross-sectional view of the arrow blades according to one embodiment of the present invention, where the arrow blades are attached to the arrow shaft by one pin, are in a closed position, and are opened and closed by means of a stationary gear that engages the threads on each of the arrow blades simultaneously.

FIGS. 7A-7C show a similar arrangement of the arrow blades 10 to that of FIGS. 6A-6C, except that the arrow blades 10 are attached to the arrow shaft 4 by a single pin 34 at the center of the arrow shaft 4. In this arrangement, the arrow blades 10 have threads 31. A gear 27 is attached to the arrow shaft 4 so that the threads of the gear 27 engage the threads 31 of the arrow blades. In addition, the tip shaft 16 has at its end a grooved bar 29 that having internal female threads 33 configured to engage the threads of the gear 27. In practice, as the tip shaft 16 moves toward the back of the arrow, the female threads 33 of the grooved bar 29 engage the threads of the gear 27 so that the gear 27 begins to turn. As the gear 27 turns, the threads of the gear 27 engage the threads 31 of the arrow blades 10, thereby causing the arrow blades to open. Conversely, as the tip shaft 16 moves toward the front of the arrow shaft 4, the female threads 33 of the grooved bar 29 engage the gear 27 and cause the gear 27 to turn in an opposite direction, thereby causing the arrow blades to close.

FIGS. 8A-8E show an alternative embodiment of the arrow having deployable blades for hunting. In this embodiment, the arrow tip assembly 112 and the nock lock assembly 114 are substantially similar to those of the embodiment shown in FIGS. 1A-1D. One difference between the embodiments, however, is the arrow blades 110. Whereas the arrow blades 10 of the embodiment of FIGS. 1A-1D are attached to the arrow shaft 4 by either one or two pins at a position substantially near the cam 24, the arrow blades 110 of the embodiment of FIGS. 8A-8E are preferably attached to the arrow shaft 104 by a single pin 134 remotely located from the cam 124.

Figure 8A:
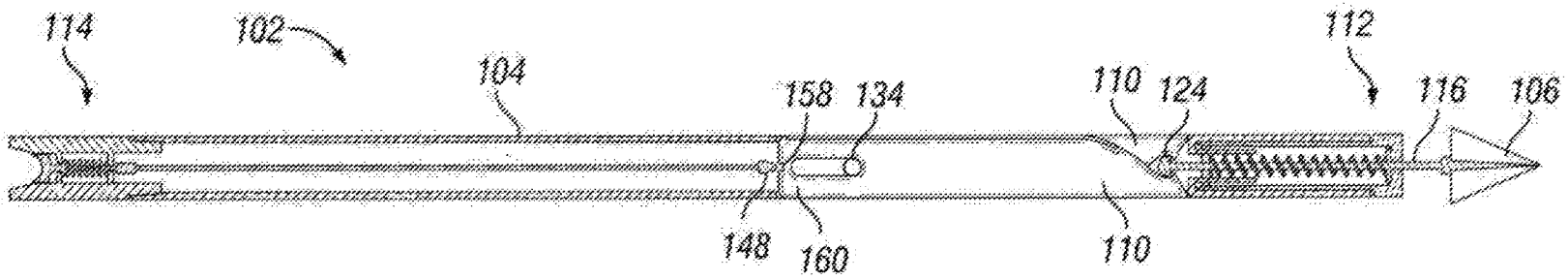
FIG. 8A is a cross-sectional view of another embodiment of the arrow of the present invention that has arrow blades in the arrow shaft.
Figure 8B:
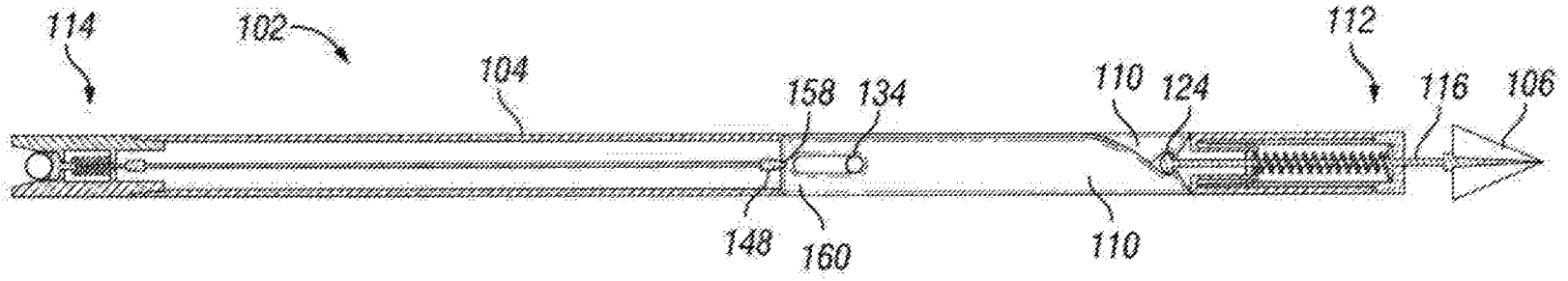
FIG. 8B is a cross-sectional view of the arrow shown in FIG. 8A, showing how the tension of the arrow tip assembly can be adjusted, and showing the blade locking mechanism of the nock locking assembly engaged with the arrow blades.
Figure 8C:
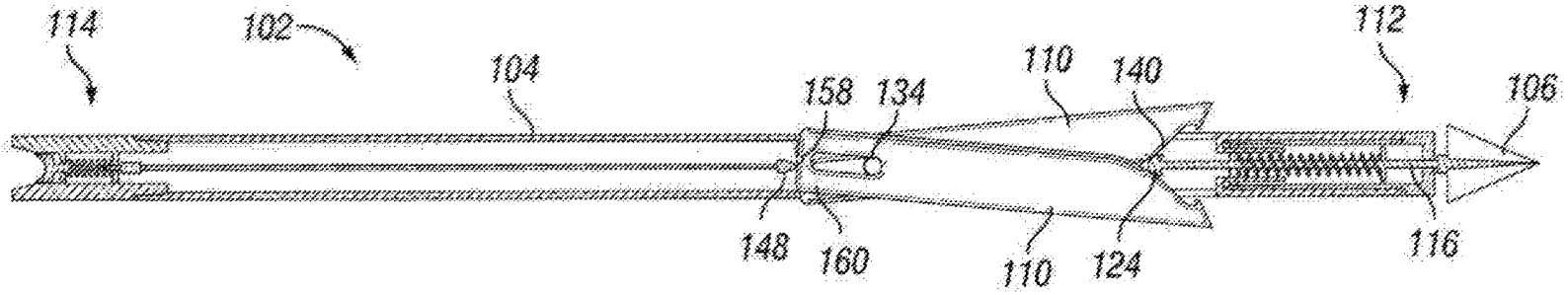
FIG. 8C is a cross-sectional view of the arrow of FIGS. 8A and 8B, and showing the arrow blades as they begin to open from the arrow shaft as the arrow tip is compressed relative to the arrow shaft.
Figure 8D:
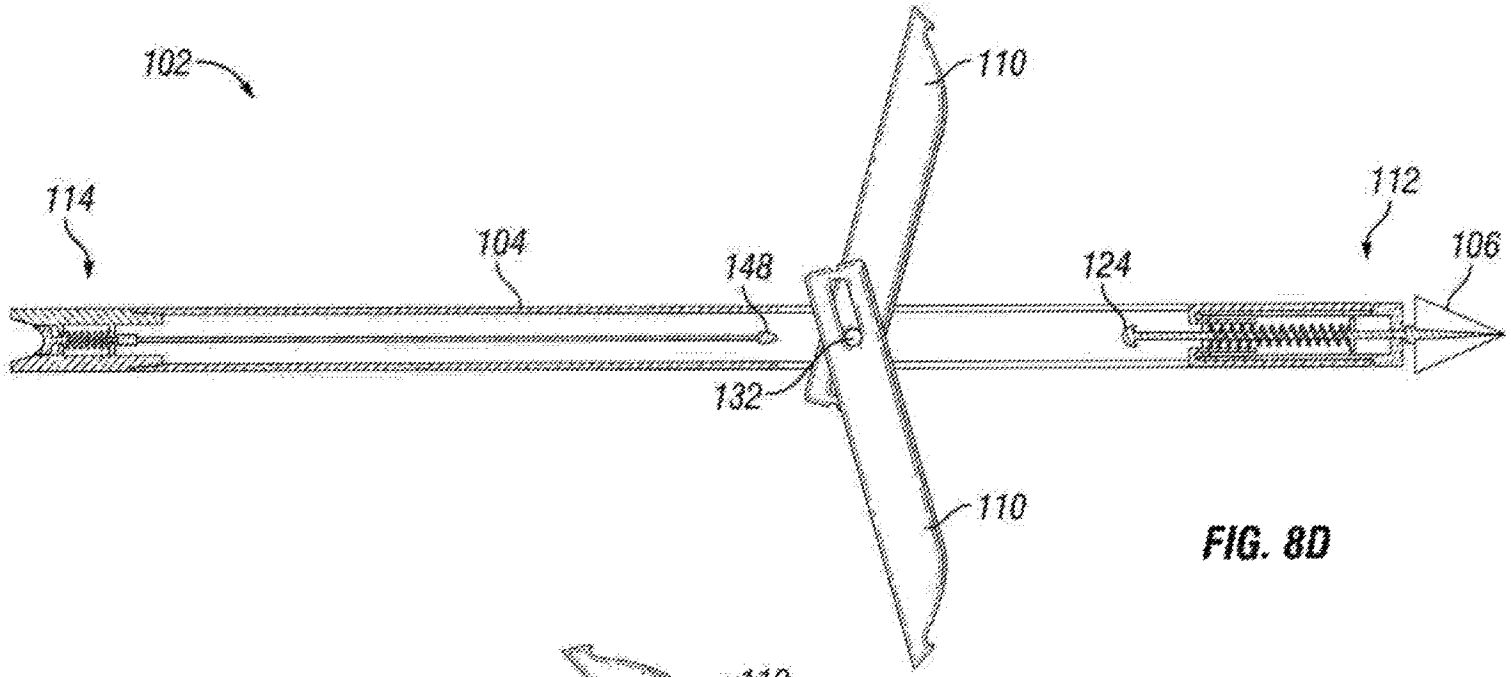
FIG. 8D is a cross-sectional view of the arrow of FIGS. 8A-8C, and showing the arrow blades in a partially open, or intermediate position.
Figure 8E:
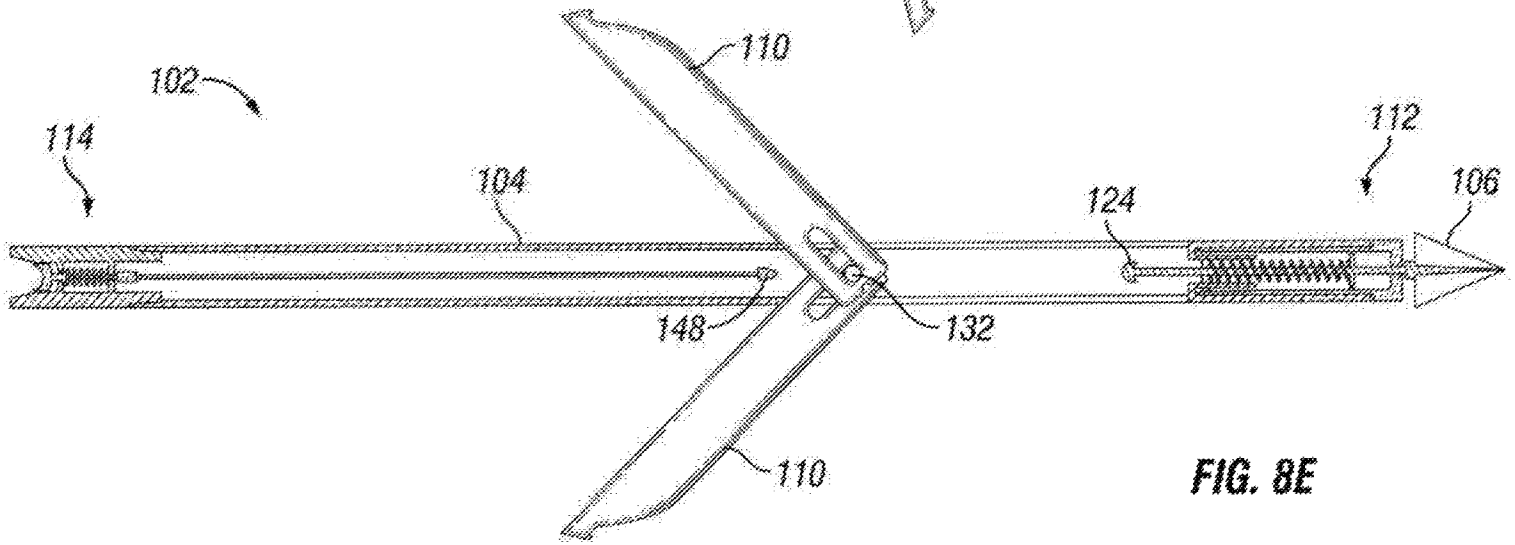
FIG. 8E is a cross-sectional view of the arrow of FIGS. 8A-8D, and showing the arrow blades in a fully open position.

In practice, upon impact with a target, the arrow tip 106, as well as the attached tip shaft 116 and cam 124, compress inwardly relative to the arrow shaft 104. As it moves inwardly, the cam 124 pushes against the inner surfaces 140 of the arrow blades 110. The inner surfaces 140 of the arrow blades are shaped so that as the cam 124 pushes against them, the arrow blades 110 are pushed radially outwardly from the arrow shaft 104, pivoting around pin 134. FIG. 8C shows the arrow blades 110 beginning to open as the cam 124 pushes against the inner surfaces 140 of the blades 110. As can be seen by inspection of FIGS. 8D and 8E, once the blades have begun to open, they will continue until they reach a fully open position (shown in FIG. 8E), even though the cam 124 may cease to drive the movement of the blades 110. This continued opening of the blades 110 is caused by forces external to the arrow tip assembly 112, such as, for example, the momentum of the arrow and/or physical contact with a target.

Another difference between the embodiment of FIGS. 8A-8E and that of FIGS. 1A-1D is in the shape of the blade locking mechanism 148 of the nock locking assembly 114. In the embodiment of FIGS. 8A-8E, the pivot ends 160 have locking notches 158 that align when the arrow blades 110 are in a closed position. The blade locking mechanism 148 is shaped to correspond to these locking notches 158 so that when the blade locking mechanism 148 and the locking notches 158 are engaged, the arrow blades 110 are constrained from opening. As described above, the nock locking assembly 114, including the blade locking mechanism 148, is arranged and designed to lock the arrow blades 110 in a closed position when the arrow 102 is nocked in a bow string, but to release the blades when the nock 108 leaves the bowstring.

Figure 8F:
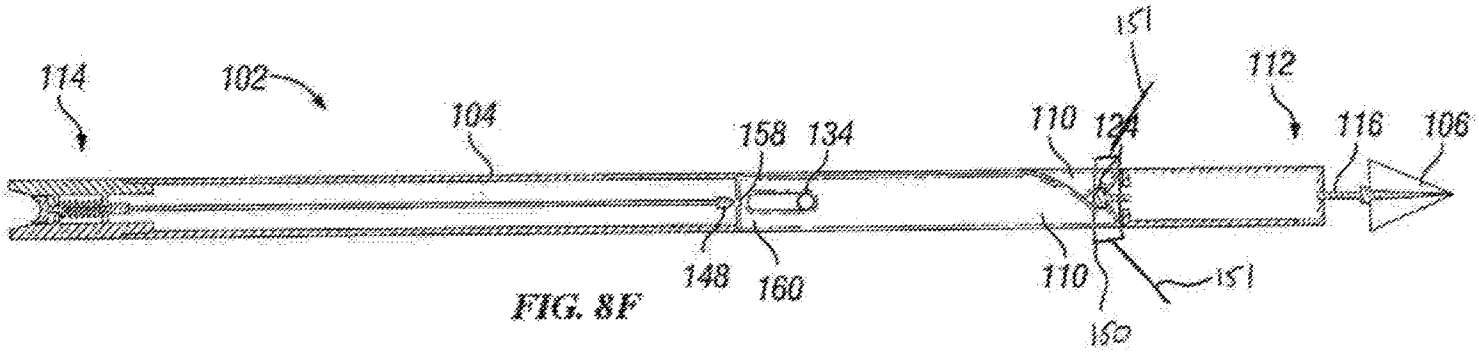
FIG. 8F is a cross-sectional view of another embodiment of the arrow of the present invention that has arrow blades in the arrow shaft and a shaft collar in a first position.

FIG. 8F is a cross-sectional view of another embodiment of the arrow of the present invention that has arrow blades in the arrow shaft and a shaft collar in a first position. FIG.

8G is a cross-sectional view of another embodiment of the arrow of the present invention that has arrow blades in the arrow shaft and a shaft collar in a second position. FIG. 8H is a cross-sectional view of another embodiment of the arrow of the present invention that has arrow blades in the arrow shaft and a shaft collar in a third position. These Figures will be described in conjunction with one another.

Figure 8G:
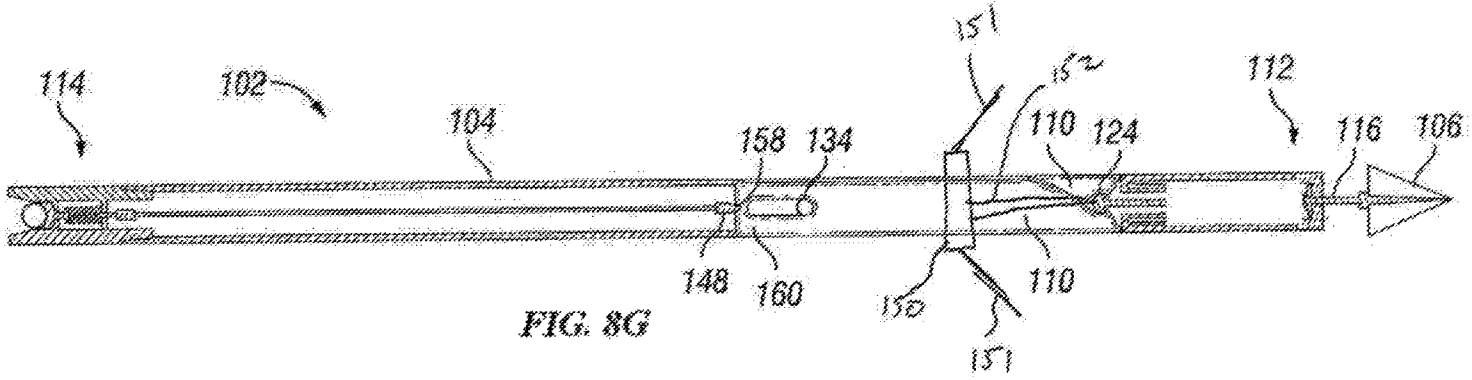
FIG. 8G is a cross-sectional view of another embodiment of the arrow of the present invention that has arrow blades in the arrow shaft and a shaft collar in a second position.
Figure 8H:
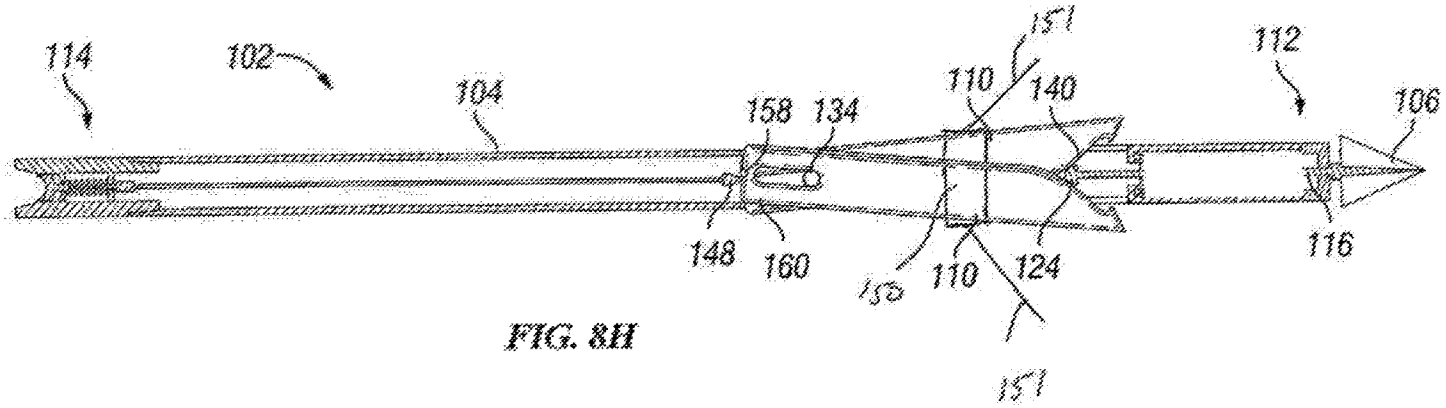
FIG. 8H is a cross-sectional view of another embodiment of the arrow of the present invention that has arrow blades in the arrow shaft and a shaft collar in a third position.

FIGS. 8F-8H illustrate a particular embodiment of a ballistic arrow that is similar to the arrow illustrated in FIGS. 8A-8D with several notable differences. First, the spring (labeled 28 in FIG. 1A for example) can be omitted from this embodiment and the tip 106 can be fixed to the shaft. Secondly, shaft collar 150 can be at least partially coupled to arrow shaft 104 so that its position may be axially adjusted along the length of the arrow shaft 104 (such as, for example, through a sliding motion).

Shaft collar 150 can include one or more shaft collar flanges 151 that can include protrusions, lips, protuberances, or the like, extending outwardly from shaft collar 150. In the examples depicted in FIGS. 8F-8H, for example, shaft collar 150 can take the shape of an annulus disc or hollowed cylinder and shaft collar flanges 151 can include prongs that extend linearly from a portion of the shaft collar 150. Other shapes and designs of shaft collar 150 and shaft collar flanges 151 are contemplated as well.

Shaft collar 150 can be composed of metals, such as steel, aluminum, etc. or it can be formed with plastics, or other composite materials. Alternatively, shaft collar 150 can be comprised of a wire or other flexible or lightweight material. Furthermore, shaft collar 150 can include blade actuator 152 that can include a wire, string, or other lightweight type material that can be used to actuate the movement arrow blades 110 from an open to a closed position and vise-versa.

The shaft collar 150 can be positioned anywhere along the arrow shaft 104 and it can adjusted to slide over arrow shaft 104 to deploy the arrow blades 110. The shaft collar flanges 151 can be used to extend beyond the outer radius of tip 106 such that the shaft collar flanges 151 can penetrate portions of the target beyond the outer diameter penetrated by the tip 106 as it contacts its target. The position of the shaft collar 150 relative to the arrow shaft 104 can affect the timing for deployment of the arrow blades 110. For example, if the shaft collar 150 is positioned near the tip 106 (e.g., as shown in FIG. 8F), the arrow blades 110 can deploy at impact or even just prior to impact. If the shaft collar 150 is positioned farther back away from the tip 106 (e.g., as shown in FIG. 8G), the arrow blades 110 can deploy after the tip 106 penetrates the target. This adjustability can be important because the dynamics of "small in" and "large out" is important in ballistics because the amount of kinetic energy ("KE") dissipated can be adjusted such that the KE dissipates within the target rather than upon impact.

In a two-blade configuration (as depicted in FIGS. 8G and 8H), the blade actuator 152 can be drawn through the arrow 102 to deploy the arrow blades 110. Alternatively, the shaft collar 150 can be implemented with one or more pins to slide open the arrow blades 110. Additionally, the shaft collar 150 can include wire or rollers to allow for less friction to slide open.

The arrow blades 110 can be coupled to the shaft 104 by a pin 134. When the blades are in the closed position, they can be angled such that they provide a sliding surface for the shaft collar 150. As the shaft collar flanges 151 impact the target, the shaft collar 151 can move away from the tip 106, which can, in turn, cause the blade actuator 152 to open the arrow blades 110 (as shown, for example, in FIG. 8H).

Figure 9A:
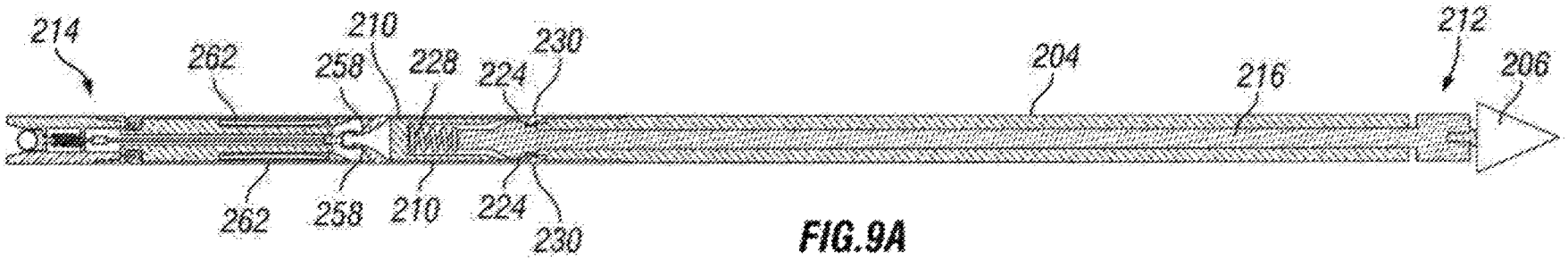
FIG. 9A is a cross-sectional view of yet another embodiment of the arrow of the present invention having arrow blades that are mounted at the back of the arrow shaft and face forward.
Figure 9B:
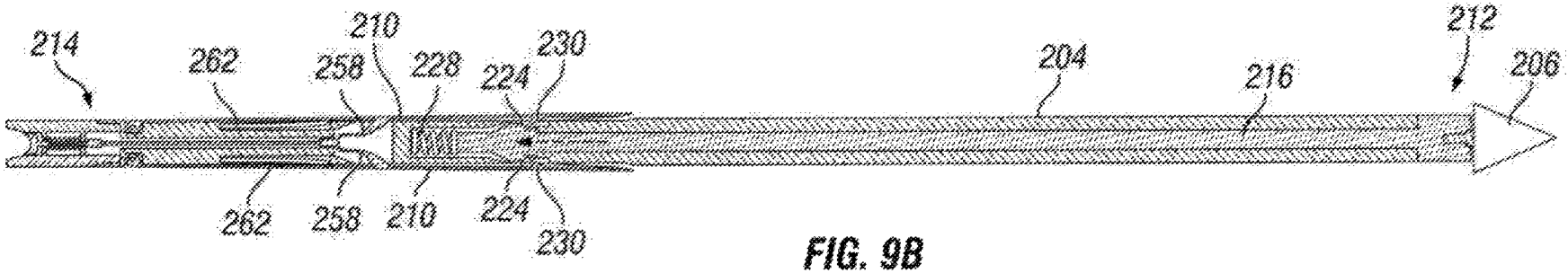
FIG. 9B is a cross-sectional view of the arrow of FIG. 9A, and showing the arrow blades in a partially deployed position as the arrow tip is compressed relative to the arrow shaft.
Figure 9C:
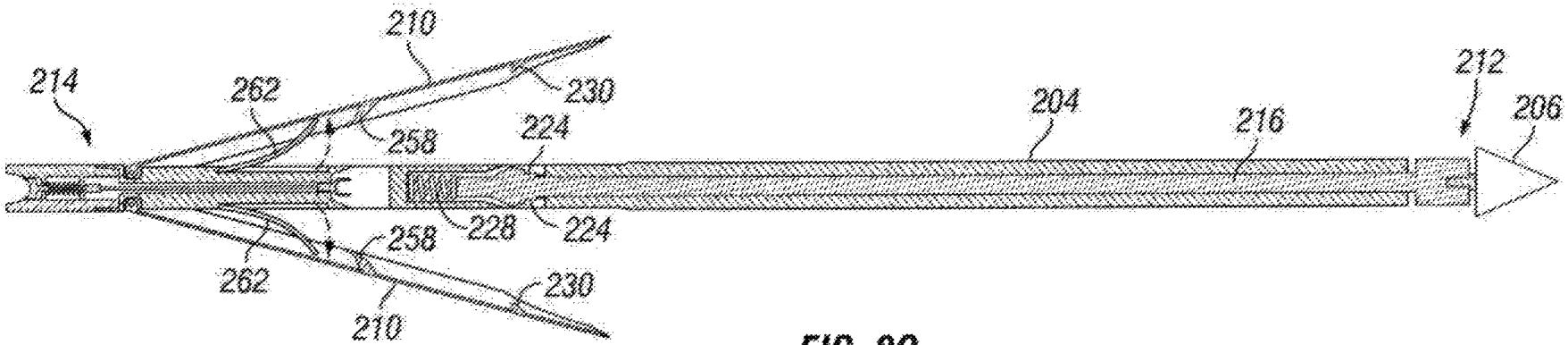
FIG. 9C is a cross-sectional view of the arrow of FIGS. 9A and 9B, and showing the arrow blades in a fully deployed position.

FIGS. 9A-9C show another embodiment of the arrow having deployable arrow blades 210 for hunting, where when the arrow blades 210 are fully deployed, they are angled relative to the arrow shaft 204 in an opposite direction to those of the above embodiments. In the embodiment of FIGS. 9A-9C, the arrow tip assembly 212 includes an arrow tip 206, a tip shaft 216, a spring 228 (or similar mechanism or material), and blade releasing protrusions 224. The arrow blades 210 may be positioned anywhere on the arrow shaft 204, and include arrow engagement protrusions 230 that are arranged to engage the blade releasing protrusions 224 when the arrow blades 210 are in a closed position against the arrow shaft 204. Also included are flexible risers 262 that are positioned between the arrow shaft 204 and the arrow blades 210, and that are biased to push the arrow blades 210 radially outward from the arrow shaft 204. As in the above-disclosed embodiments, the spring 228 is biased to urge the arrow tip 206 away from the arrow shaft 204 by exerting a force on the end of the tip shaft 216. This same biasing force urges the blade releasing protrusions 224 into engagement with the arrow engagement protrusions 230 of the blades 210 so that the blades remain closed relative to the arrow shaft 204.

In practice, when the arrow strikes a target, the arrow tip 206 and tip shaft 216 are compressed inwardly toward the arrow shaft 204, thereby compressing the spring 228. As the tip shaft 216 moves inwardly relative to the arrow shaft 204, the blade releasing protrusions 224 disengage from the arrow engagement protrusions 230 of the blades, as shown in FIG. 9B. Thereafter, the flexible risers 262 force the blades radially outward into an open position, as shown in FIG. 9C.

The embodiment of FIGS. 9A-9C may also include a nock locking assembly 214, similar to that disclosed in the above embodiments. In this embodiment, the blade locking mechanism 248 is arranged to engage locking notches 258 when the arrow 202 is notched in a bowstring, and to release the arrow blades 210 when the arrow is released from the bowstring.

Figure 10A:
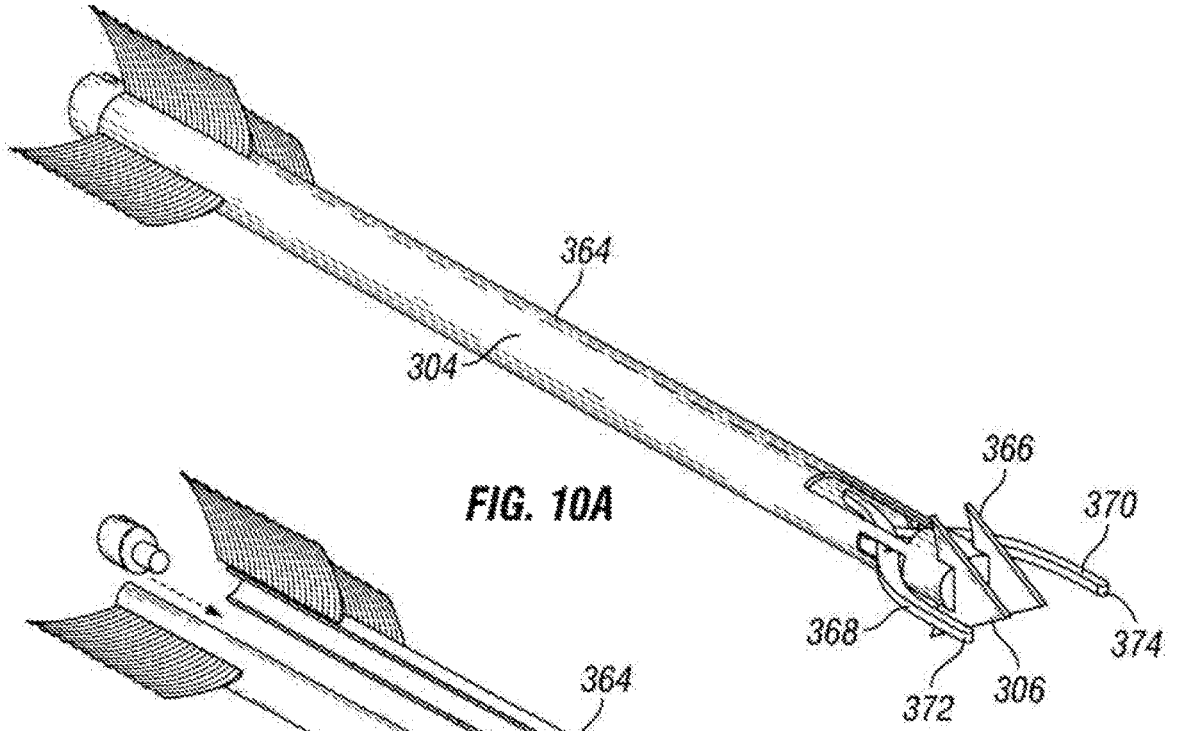
FIG. 10A is a perspective view of a split shaft arrow according to one embodiment of the present invention.
Figure 10B:
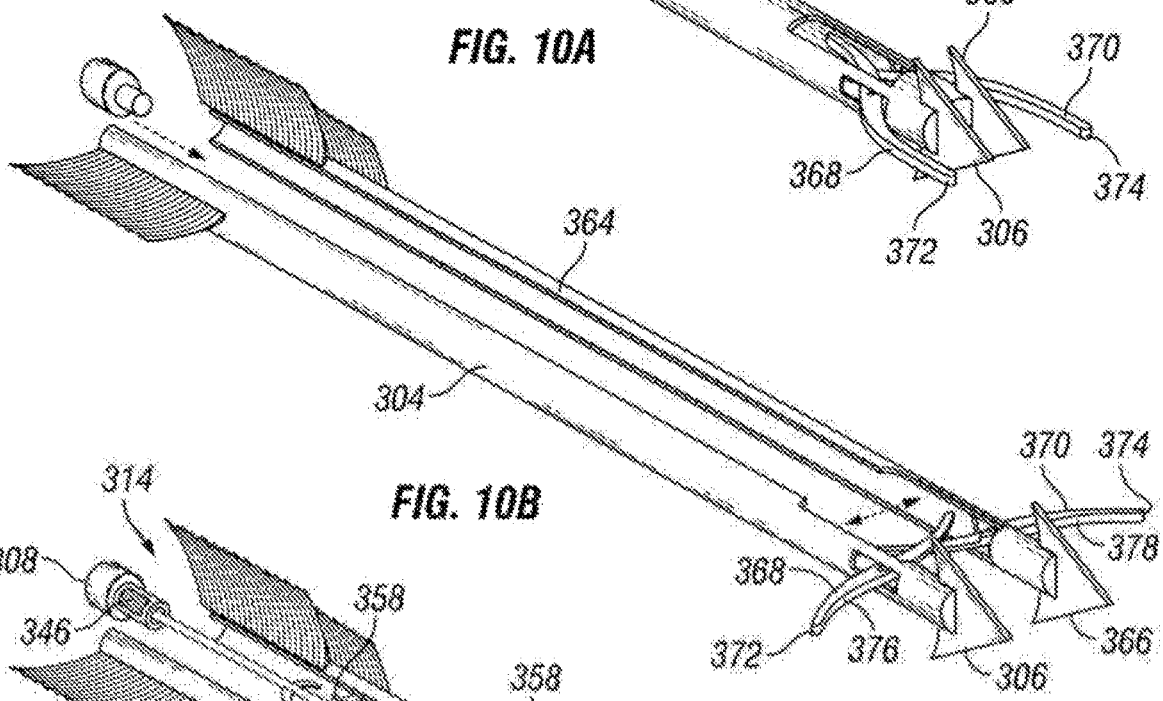
FIG. 10B is a perspective view of the split shaft arrow of FIG. 10A after the shaft has split into two parts.
Figure 10C:
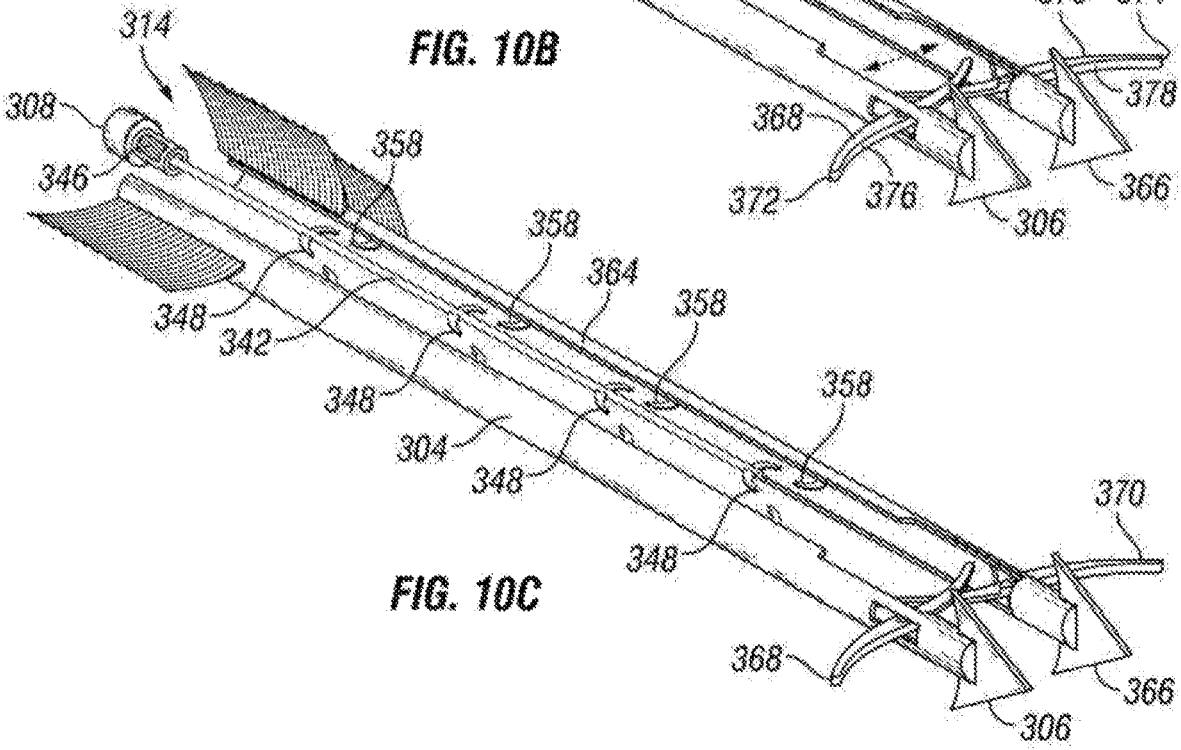
FIG. 10C is a perspective view of the split shaft arrow of FIGS. 10A and 10B after the shaft has split into two parts, and showing the nock locking assembly that may help to connect the parts of the shaft during nocking and firing of the arrow.

FIGS. 10A-10C show another arrow that is designed to break into two longitudinal arrow shaft parts 304, 364 upon contacting a target. To this end, the shaft of the arrow consists of two separate parts that are preferably, although not necessarily, substantially symmetrical about a longitudinal plane of the arrow, and that are releasably attached to one another. The parts may be attached by any appropriate means, such as, for example, adhesive, tape, plastic restraints, or heat shrink wrap. Alternatively, or in addition to adhesive or tape, the shaft parts may be held together by the nock locking assembly 314, which is discussed in further detail below. The tip of the arrow may preferably have two arrow heads 306, 366 attached to the end of the shaft parts 304, 364. A pair of trigger blades 368, 370 are pivotally mounted to the shaft parts 304, 364. One purpose of the trigger blades 368, 370 is to split the arrow shaft into separate parts upon impact with a target. For example, as shown in FIG. 10B, when the outer ends 372, 374 of the trigger blades 368, 370 strike a target, the trigger blades 368, 370 pivot so that the inner end of each trigger blade pushes against the its neighboring shaft part. Thus, the inner end of trigger blade 368 pushes against shaft part 364, and trigger blade 370 pushes against shaft part 304. As the trigger blades 368, 370 continue to pivot, the shaft parts 304, 364 are pushed apart. The position of the trigger blades 368, 370 relative to the arrow shaft may be varied to change the timing of the splitting of the arrow shaft 304, 364.

Referring to FIG. 10C, there is shown a nock locking assembly 314 that is similar to the nock locking assemblies disclosed above, with one distinction being that the nock locking assembly 314 of this embodiment has a plurality of shaft locking mechanisms 348 configured to engage a plurality of locking notches 358 when the nock locking assembly 314 is in a locked position. The locking notches 358 may preferably be positioned on the inside of the arrow shaft parts 304, 364. Thus, when the nock locking assembly is in its locked position, the arrow shaft parts cannot be separated. As disclosed, the nock locking assembly further includes a nock 308, a nock lock shaft 335, a nock flange (not shown), and a nock spring 346. These elements work together with the shaft locking mechanisms 348 and the locking notches 358, as described above with regard to nock locking assemblies 214, 114, and 14, to ensure that the arrow shaft parts 304, 364 do not separate while the arrow is nocked in a bowstring, but that the shaft parts 304, 364 may separate as intended after release from the bowstring. In one embodiment, the nock locking assembly may separate and be discarded after the arrow shaft splits into separate parts.

In an alternative embodiment, the arrow shaft parts 304, 364 may separate upon disengagement of the shaft locking mechanisms 348 from the locking notches 358, without prompting by the trigger blades 368-370. In such an embodiment, the shaft parts 302, 364 may preferably separate while the arrow is in flight, before striking a target.

In one embodiment, it is contemplated that deployable blades, such as those shown and described in reference to FIGS. 1A-9C may be included in each arrow shaft part 304, 364. In addition, it is contemplated that the edges 376, 378 of the trigger blades 368, 370, as well as the edges of the arrow shaft parts 304, 364, may be sharpened to provide an increased number of cutting surfaces when the arrow strikes a target.

Figure 11B:
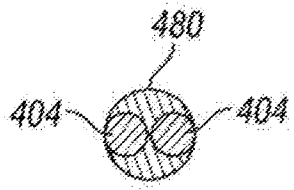
FIG. 11B is a cross-sectional view of the coupled arrow of FIG. 11A taken along the line 11B-11B.
Figure 11A:
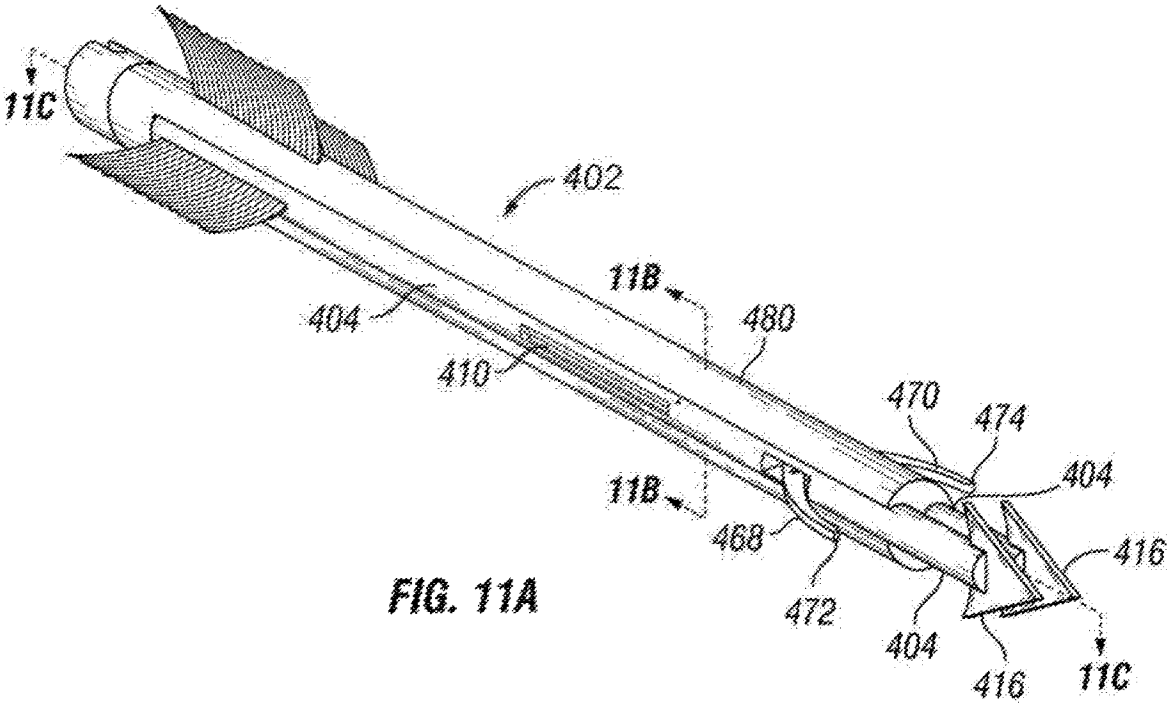
FIG. 11A is a perspective view of a coupled arrow according to one embodiment of the present invention.
Figure 11C:
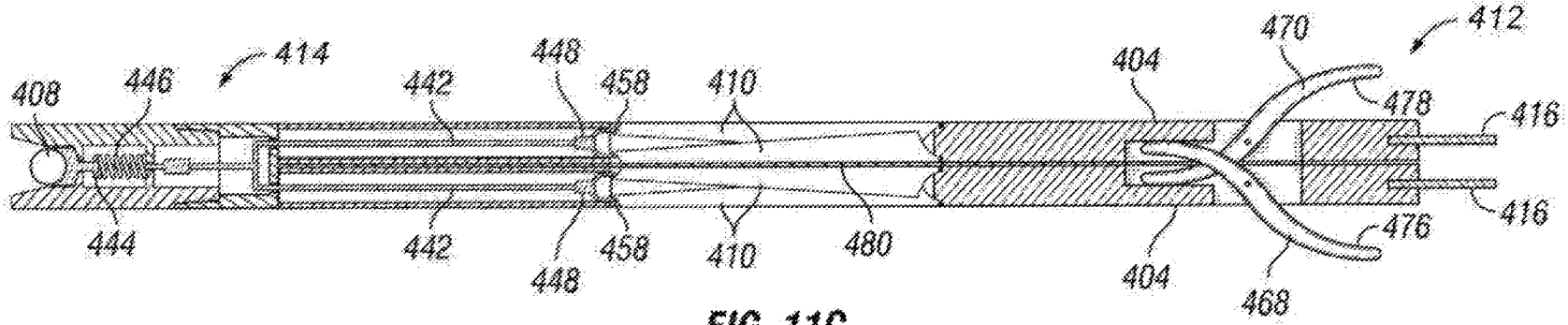
FIG. 11C is a cross-sectional view of the coupled arrow of FIG. 11C taken along the line 11C-11C.

The arrow 402 of FIGS. 11A-11C, is similar to that of FIGS. 10A-10C, except that instead of a single arrow having separable shaft parts, the arrow of FIGS. 11A-11C has two separate, but complete arrow shafts 404, bound together by a coupler 480. A cross-sectional view of this arrangement is shown in FIG. 11B. A pair of trigger blades 468, 470 are pivotally mounted to the arrow shafts 404, with one trigger blade mounted to each shaft. One purpose of the trigger blades 468, 470 is to separate the shafts from each other, and from the coupler 480, upon impact with a target. For example, when the outer ends 472, 474 of the trigger blades 468, 470 strike a target, the trigger blades 468, 470 pivot so that the inner end of each trigger blade pushes against the its neighboring arrow shaft 404. As the trigger blades 468, 3470 continue to pivot, the arrow shafts 404 are force to separate from the coupler 480 and from each other. In addition, it is contemplated that the edges 476, 478 of the trigger blades 468, 470 may be sharpened to provide an increased number of cutting surfaces when the arrow strikes a target. In addition, deployable arrow blades 410, such as, for example, those disclosed above with respect to the arrow of FIGS. 1A-1D, may be embedded in each arrow shaft 404.

The trigger blades may be positioned anywhere along the longitudinal length of the arrow shafts 404. Because the trigger blades 468, 470 do not begin to pivot until the arrow strikes a target, the distance between the tip 416 of the arrow shafts 404 and the trigger blades 468, 470 determines how quickly the arrow shafts 404 separate after hitting a target. For example, if the trigger blades 468, 470 are positioned close to the arrow tips 416, as shown in FIG. 11A, then they will impact the target and begin to separate very soon after the arrow tips 416 strike the target. Alternatively, if the trigger blades 468, 470 are positioned further back toward the nock end of the arrow, they won't impact the target and begin to separate until later, when the arrow tips 416 have already passed into the target a predetermined amount.

Referring to FIG. 11C, there is shown a nock locking assembly 314 and arrow blades similar to those described above with respect to FIGS. 1A-1D. In the embodiment of FIGS. 11A-11C, the nock 408, nock lock flange 444, and nock spring 446 are substantially similar to their counterparts shown in FIGS. 1A-1D (i.e., nock 8, nock lock flange 44, and nock spring 46). However, rather than a single nock lock shaft as disclosed above, the arrow of FIGS. 11A-11C has a pair of nock lock shafts 442, one corresponding to each separate arrow shaft 404. Each of the nock lock shafts 442 preferably leads to a blade locking mechanism 448 configured to engage locking notches 458 of arrow blades 410. Arrow shafts 404 include arrow tip assemblies 412 and arrow blades 410 that are substantially similar to those described above with regard to FIGS. 1A-9C. Thus, arrow blades 410 are in operative communication with arrow tips 416 so that they deploy radially outwardly from the arrow shafts 404 when the arrow tips 416 impact a target.

Similar to the embodiment shown in FIGS. 10A-10C, the arrow shafts 404 may separate upon disengagement of the shaft locking mechanism 448 from the locking notches 458, without prompting by the trigger blades 468, 470. In such an embodiment, the shafts 404 may preferably separate while the arrows are in flight, before striking a target.

FIGS. 12A-12F show telescoping arrow according to the present invention. When the telescoping arrow strikes a target, the front portion of the arrow expands, or telescopes outwardly, thereby extending the length of the arrow. In addition, arrow blades 510 extend from the shaft of the arrow. Each of these actions preferably takes place simultaneously in order to maximize the amount of damage inflicted on a target.

With regard to the telescoping aspect of the arrow, the shaft of the arrow 504 includes an outer shaft portion 582 and an inner shaft portion 584. The inner shaft portion 584 is surrounded by the outer shaft portion 582 and is attached at its rearward end to a spring 528 (or similar mechanism or material). The spring 528 is attached at its end to an internal component 586 that is either attached to, or integrally joined with, the outer shaft portion 582. In its neutral position, the spring 528 pushes a substantial portion of the inner shaft portion 584 outwardly in front of the outer shaft portion 582 through opening 588 (as shown, e.g., in FIGS. 12D-12F).

In addition, the outer shaft portion 582 includes at least one inner shaft engagement protrusion 530 and the inner shaft portion 584 includes at least one corresponding inner shaft release protrusion 525, Prior to impact with a target, the inner shaft portion 584 is fixed relative to the outer shaft portion 582 by the engagement of the inner shaft engagement protrusion 530 with the inner shaft release protrusion 525. When in the fixed position relative to the outer shaft portion 582, the inner shaft portion 584 is preferably in a substantially retracted position, with the spring 528 substantially compressed. In its compressed state, the spring 528 stores potential energy.

Upon impact with a target, the arrow tip 506, which is attached to the inner shaft portion 584, is pushed inwardly relative to the outer shaft at least until the inner shaft engagement protrusion 530 disengages from the inner shaft release protrusion 525. Thereafter, the spring-stored potential energy of the compressed spring is released, propelling the inner shaft portion 584 forward and away from the outer shaft portion 582 of the arrow.

Figure 12A:
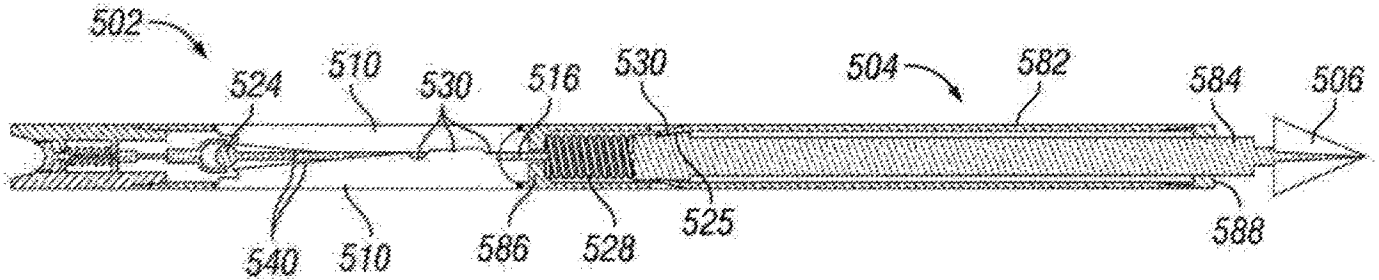
FIG. 12A is a cross-sectional view of a telescoping arrow according to one embodiment of the present invention.
Figure 12B:
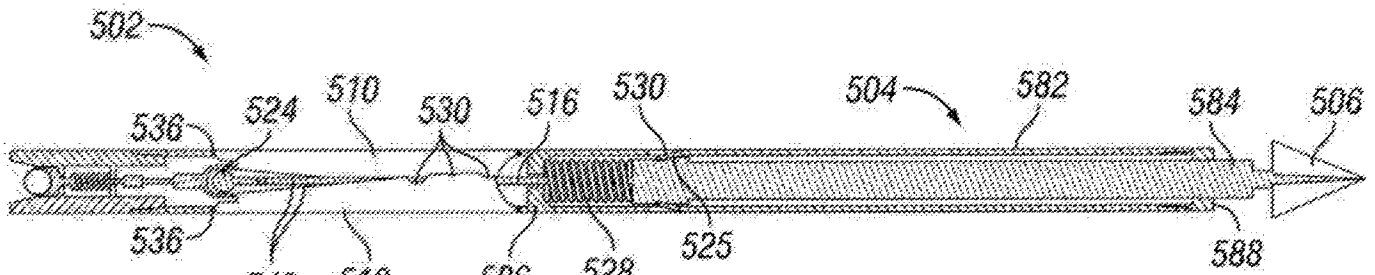
FIG. 12B is a cross-sectional view of the telescoping arrow of FIG. 12A, and showing the blade locking mechanism engaged with the arrow blades and the nock engaged with a bowstring.
Figure 12C:
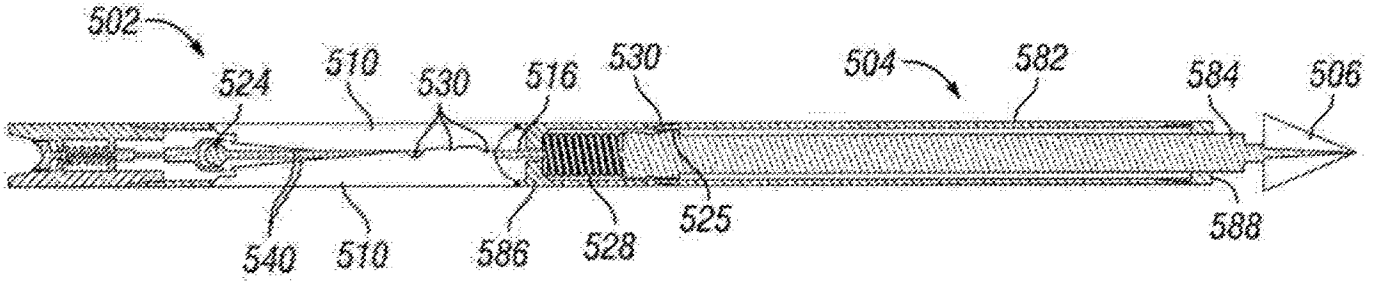
FIG. 12C is a cross-sectional view of the telescoping arrow of FIGS. 12A-12C, and showing the blade locking mechanism disengaged from the arrow blades during flight, after the nock is separated from the bowstring.
Figure 12D:
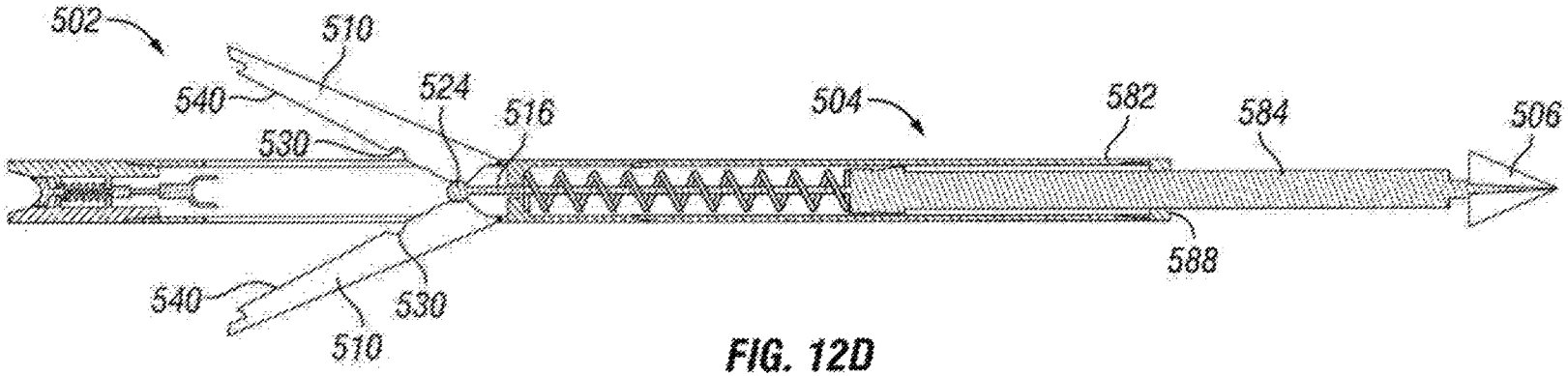
FIG. 12D is a cross-sectional view of the telescoping arrow of FIGS. 12A-12C, and showing the inner shaft section extended outwardly from the outer shaft section, and the arrow blades fully deployed.
Figure 12E:
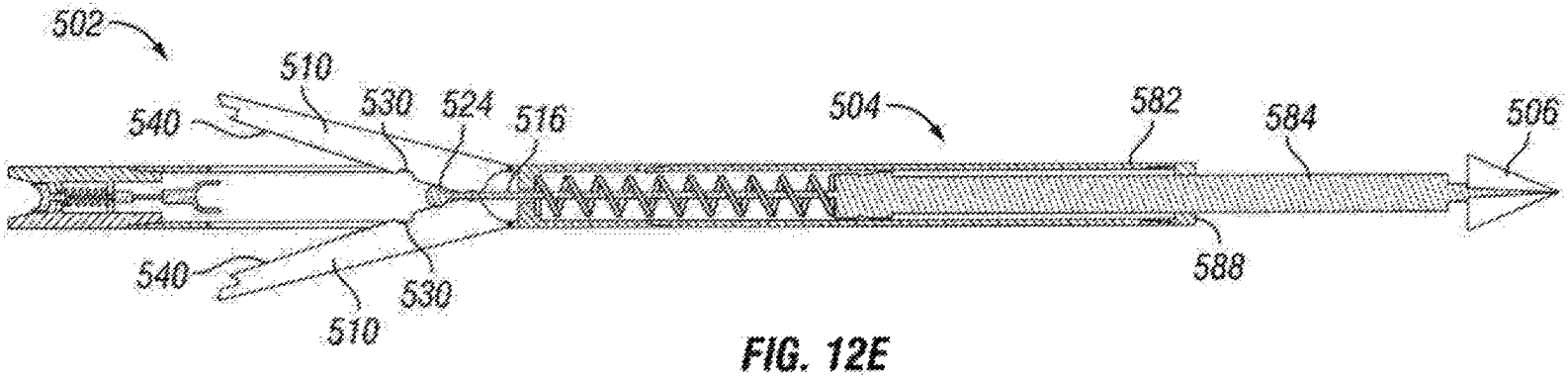
FIG. 12E is a cross-sectional view of the telescoping arrow of FIGS. 12A-12D, and showing the arrow blades in a less open position.
Figure 12F:
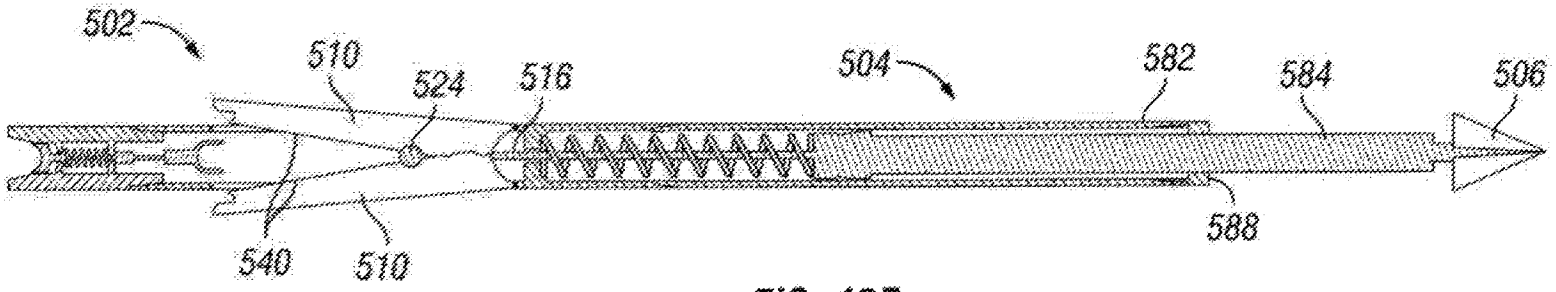
FIG. 12F is a cross-sectional view of the telescoping arrow of FIGS. 12A-12E, and showing the in still less of an open position.

Referring now to FIGS. 12D-12F, there are shown elongated arrow blades 510 which are designed to remain substantially flush with the arrow shaft 504 during loading and shooting of the arrow 502, and to deploy outwardly from the arrow shaft 504 upon impact with a target. The position of the arrow blades 10 is controlled by the relative position of the inner shaft portion 584 and the outer shaft portion 582.

The inner shaft portion 584 includes a cam shaft 516 attached to the inner shaft portion 584. The cam shaft 516 is in turn attached to a cam 524. The arrow blades 510 have notches 530 designed to accept the cam 524. As the inner shaft portion 584 travels forward, as disclosed above, the cam shaft 516 and attached cam 524 likewise travel forward. As it travels forward, the cam 524 contacts the inner surfaces 540 of the arrow blades 510, thereby pushing the arrow blades radially outwardly from the sides of the arrow shaft 4, as shown in FIGS. 12D-12F. Preferably, the arrow blades 510 include a number different notches 530 located at different positions along the inside of the arrow blades 510 and configured to engage the cam 524 as it moves inwardly relative to the arrow shaft 504, thereby locking the arrow blades 510 in an open position.

The inner surfaces 540 of the arrow blades 510 are preferably tapered so that the further forward the cam 524 travels relative to the arrow blades 510, the greater the radial distance that the arrow blades 510 open from the sides of the arrow shaft 504. In other words, when the cam 524 travels only a short distance forward, the arrow blades 510 open at a shallow angle relative to the arrow shaft 504. Conversely, when the cam 524 travels a greater distance forward, the arrow blades 510 open at a greater angle. Accordingly, when the arrow tip 506 impacts a soft target, the arrow tip 506, and in turn the cam 524, encounters little resistance as it telescopes forward, thereby forcing the arrow blades 510 to open widely from the arrow shaft 504. However, when the arrow head impacts a hard target, the arrow tip 506, and in turn the cam 524, is restricted in its forward telescoping movement, thereby opening the arrow blades 510 at a lesser angle.

The arrow of FIGS. 12A-12F also includes a nock locking assembly, substantially similar to the nock locking assembly disclosed above with respect to FIGS. 1A-1D. As discussed above, one purpose of the nock locking assembly is to constrain the arrow blades 510 from deploying while the arrow is nocked in a bowstring. In addition to the nock locking assembly, additional means may be provided to constrain the arrow blades 510 from opening, such as for example, and "o" ring 536 (shown in FIG. 12B), or a heat shrink seal around the arrow blades 510 (not shown).

Figure 13A:
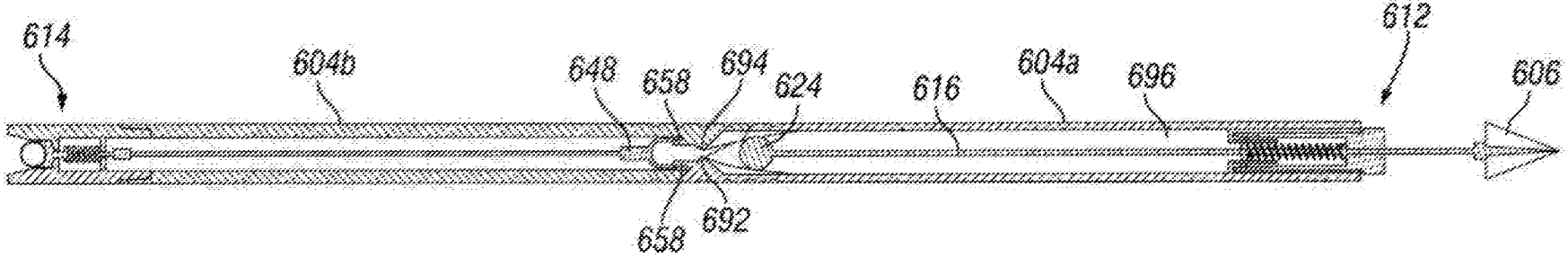
FIG. 13A is a cross-sectional view of a break away arrow according to one embodiment of the present invention.
Figure 13B:
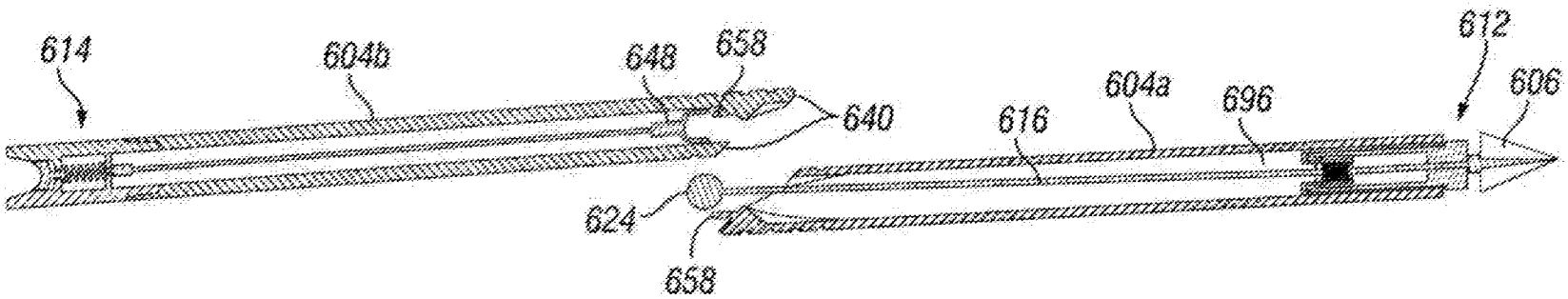
FIG. 13B is a cross-sectional view of the break away arrow of FIG. 13A, and showing the back shaft section separating from the front shaft section.

FIGS. 13A and 13B depict a hunting arrow having a shaft that is designed to break into a front part 604*a* and a back part 604*b* upon impact with a target. The two parts are joined together, as shown in FIG. 13A, during nocking and firing of the arrow. Preferably, the arrow includes a nock locking assembly 614 that is substantially similar to that disclosed above with regard to other arrow designs (e.g., the nock locking system 14 of the arrow of FIGS. 1A-1D). The nock locking system 614 includes a shaft locking mechanism 648 (similar to the blade locking mechanism 48 disclosed above) that is configured to engage locking notches 658 attached to the front and back parts of the arrow shaft 604*a*, 604*b*. The engagement of the shaft locking mechanism 648 with the locking notches 658 prevents the parts of the shaft 604*a*, 604*b* from separating during nocking and firing of the arrow. Additional means may be used to attach the parts of the shaft together in addition to the nock locking assembly, such as, for example, o-rings (not shown), tape, adhesive, plastic constraints, or heat shrink wrap.

When the arrow strikes a target, the front part of the shaft 604*a* is designed to break away from the back part of the shaft 604*b*. To accomplish this, the arrow of FIGS. 13A and 13B is preferably hollow, defining an interior space 696. The arrow also preferably includes an arrow tip assembly 612 that is substantially similar to the arrow tip assembly 12 shown in FIG. 2, including a cam 624 that is operatively connected to the arrow tip 606, and that, when the arrow is fired, is located in the front part of the arrow shaft 604*a*, as shown in FIG. 13A. The cam 624 is connected to the arrow tip 606 via a tip shaft 616, so that when the arrow tip 606 is compressed relative to the arrow shaft, such as when the arrow tip 606 strikes a target, the cam 624 moves longitudinally toward to back part of the shaft 604*b*. The interior space 696 of the arrow shaft includes shaft separation protrusions, including a front shaft separation protrusion 692 and a back shaft separation protrusion 694. The separation protrusions 692, 694 are arranged substantially adjacent one another inside the shaft so that they at least partially fill a part of the interior space 696.

In practice, when the arrow strikes a target, the arrow tip 606 is compressed relative to the arrow shaft 604. As a result, the cam 624 is pushed backward through the interior space 696 of the shaft and into contact with the shaft separation protrusions 692, 694. The diameter of the cam 624 is greater than the space between the shaft separation protrusions 692, 694 so that as the cam passes between the shaft separation protrusions 692, 694, the back part of the shaft 604*b* is pushed away from the front part of the shaft 604*a*. Accordingly, the arrow separates into two separate pieces, as shown in FIG. 13B. In a preferred embodiment, the forward edges 640 of the back part of the shaft 604*b* are sharp so as to increase the amount of damage caused when the back part of the shaft 604*b* strikes the target. Additionally, deployable arrow blades similar, for example, to those of the embodiment of FIGS. 1A-1D, may be embedded in one or both parts of the arrow shaft 604*a*, 604*b*.

Figure 14A:
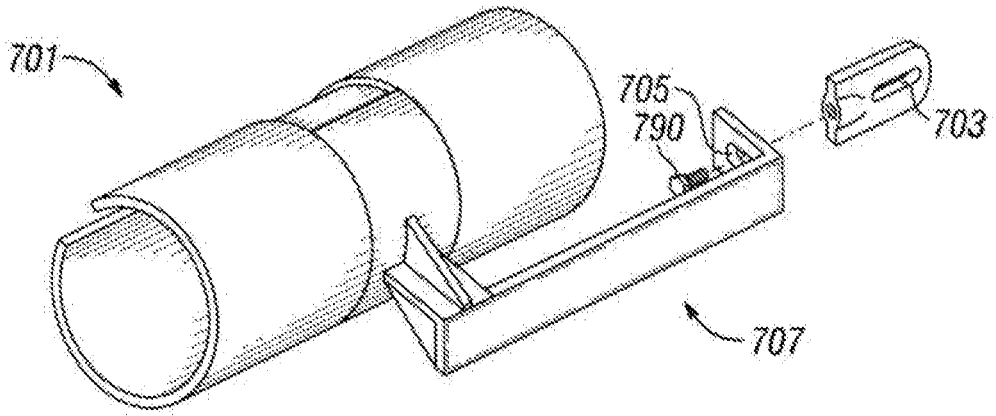
FIG. 14A is a perspective view of a safety bracket according to one embodiment of the present invention.
Figure 14B:
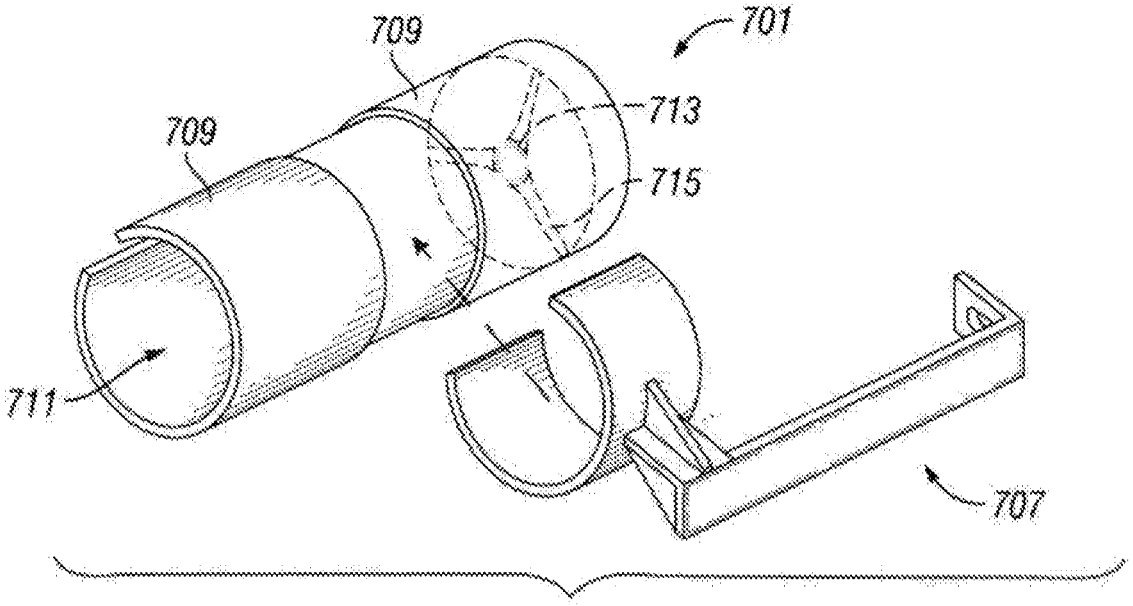
FIG. 14B is a partially exploded perspective view of the safety bracket shown in FIG. 14A, including 3 pins for supporting an arrow.
Figure 14C:
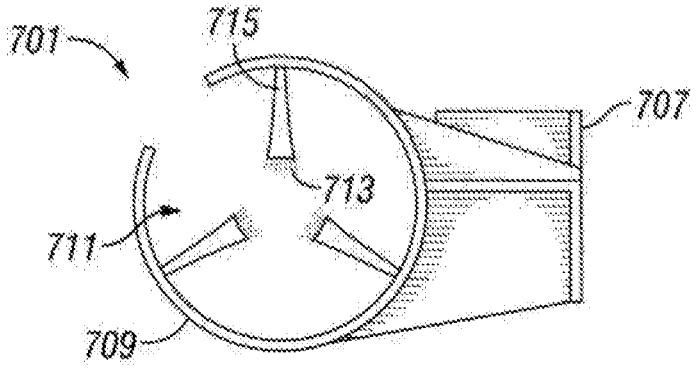
FIG. 14C is an end view of the safety bracket shown in FIGS. 14A and 14B.

FIGS. 14A-14C show a safety bracket 701 that may be attached to bow (not shown) to protect an archer from injury while shooting an arrow. The safety bracket preferably includes a protective outer casing 709 and an attachment portion 707 that is separable from the rest of the safety bracket, as shown in FIG. 14B. The protective outer casing substantially surrounds an arrow path 711. Preferably, at least a portion of the inside of the outer casing 709 includes arrow supports 715 (shown in FIGS. 14B and 14C). The arrow supports may have brushes 713 (or similar material) on the ends thereof.

The safety bracket 701 may be attached to the bow using fasteners 790 inserted through holes 703, 705. Holes 703, 705 are preferably elongate to allow adjustment of the safety bracket 701 relative to the bow depending on the need or preference of the archer. For example, elongated hole 703 may allow for adjustment of the safety bracket 701 toward or away from the bow, and hole 705 may allow adjustment of the safety bracket 701 between the left and right sides of the bow handle. As can be seen in the exploded view of FIG. 14B, the elongated holes 703, 705 of the safety bracket may be inserted through an attachment portion 707 of the safety bracket that is separable from the rest of the safety bracket 707.

In use, the safety bracket 701 is attached to a bow so that the arrow path 711 of the safety bracket is aligned with the correct position of the arrow relative to the bow when the arrow is nocked. The protective outer casing 709 is positioned between the arrow and the arm, wrist, and hand of the archer. When the arrow is inserted into the safety bracket, the position of the arrow is maintained by the brushes 713 (or similar material) and/or arrow supports 715. Upon firing, the arrow passes through the safety bracket 701 and away from the bow. Throughout the process the protective outer casing 709 remains between the archer and the arrow, thereby protecting the archer from injury by the arrow.

Figure 15A:
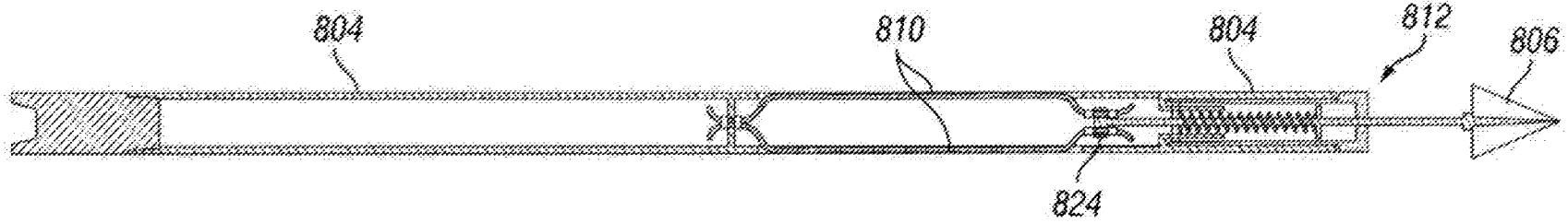
FIG. 15A is a cross-sectional view of an arrow according to one embodiment of the present invention that has wire embedded in the shaft instead of arrow blades.
Figure 15B:
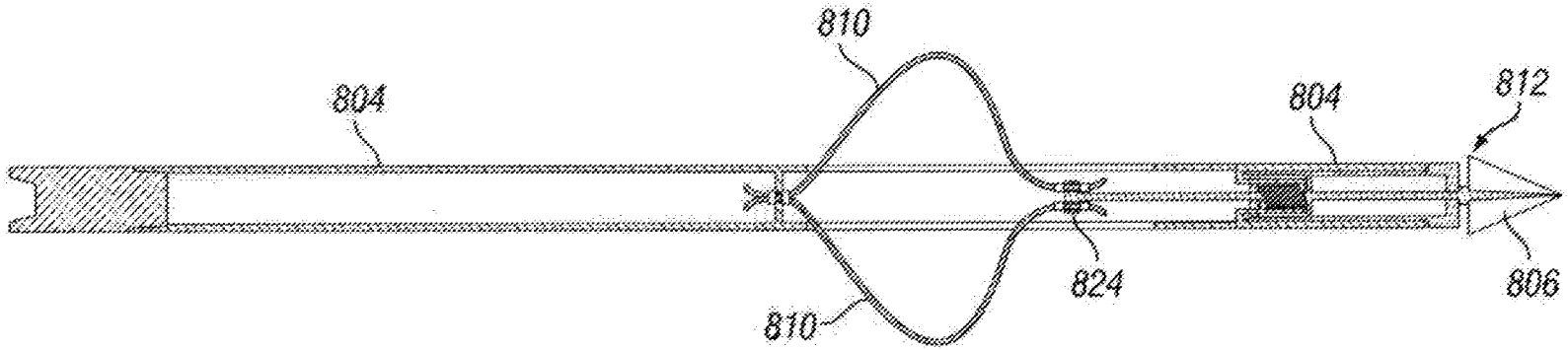
FIG. 15B is a cross-sectional view of the arrow of FIG. 15A, and having the wire deployed outwardly from the arrow shaft.

FIGS. 15A and 15B show an arrow that has deployable strands of sharp wire 810 in the arrow shaft 804, instead of deployable arrow blades. The wire 810 is preferably fixed at the back end to the arrow shaft 804, and attached at the front end to the moveable cam 824 of an arrow tip assembly 812. The arrow tip assembly 812 is substantially the same as the arrow tip assembly 12 described above with reference to FIG. 2. In practice, when the arrow tip 806 strikes an object, and is therefore compressed relative to the arrow shaft 804, the cam 824 moves backward relative to the arrow shaft 804. Because the back end of the wire 810 is fixedly attached to the arrow shaft 804, while the front end is attached to the cam 824, the distance between the back and the front ends of the wire 810 is decreased. This causes the wire 801 to expand outwardly from the arrow shaft 804, as shown in FIG. 15B.

Figure 16A:
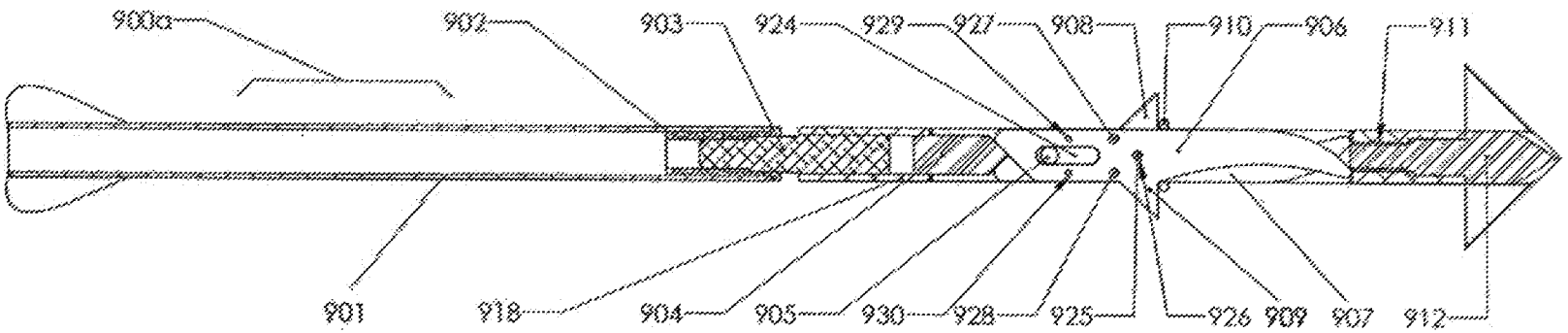
FIG. 16A is a cross-sectional view of a first embodiment of an arrow according to the present invention having a fixed broad head and an extended shaft having blades in a closed position.
Figure 16B:
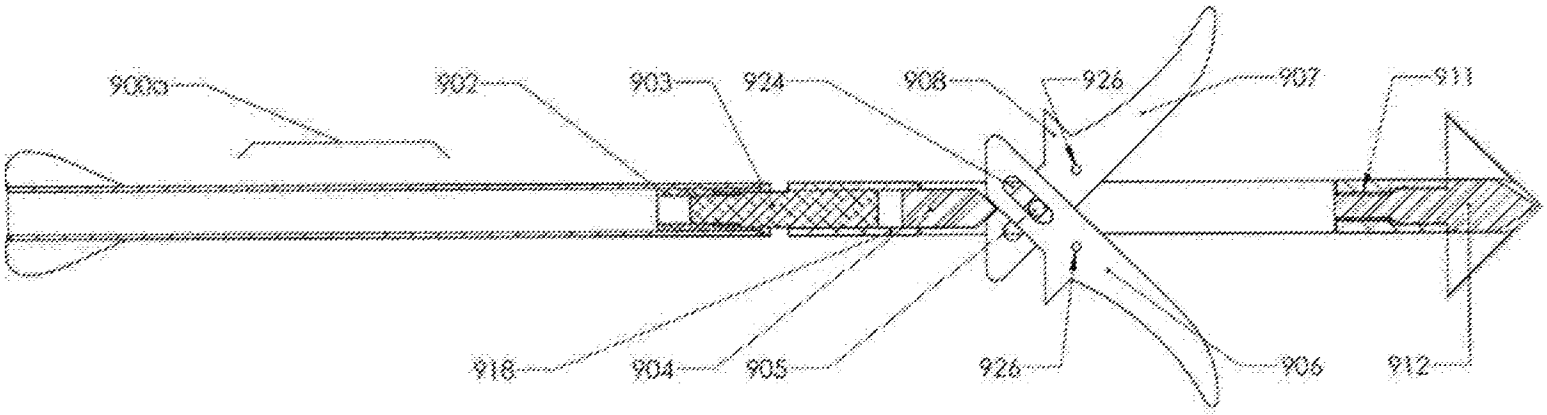
FIG. 16B is a cross-sectional view of the first embodiment of an arrow as illustrated in FIG. 16A according to the present invention having a fixed broad head and an extended shaft having blades in a partially deployed position.
Figure 16C:
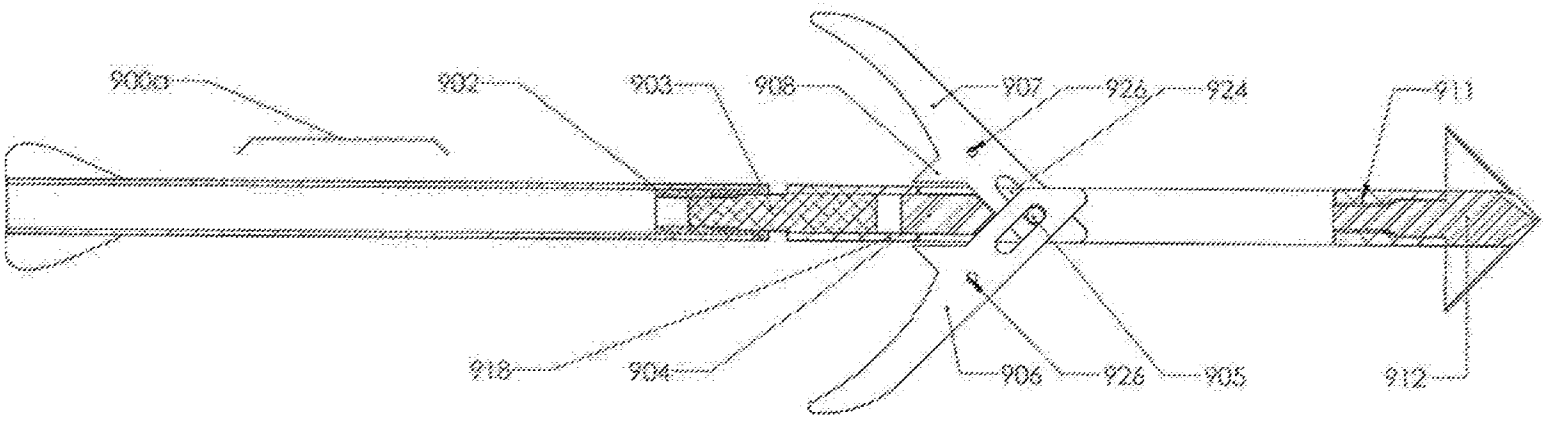
FIG. 16C is a cross-sectional view of the first embodiment of an arrow as illustrated in FIG. 16A according to the present invention having a fixed broad head and an extended shaft having blades in an open and locked position.

FIG. 16A is a cross-sectional view of a first embodiment of an arrow according to the present invention having a fixed broad head and an extended shaft having blades in a closed position. FIG. 16B is a cross-sectional view of the first embodiment of an arrow as illustrated in FIG. 16A according to the present invention having a fixed broad head and an extended shaft having blades in a partially deployed position. FIG. 16C is a cross-sectional view of the first embodiment of an arrow as illustrated in FIG. 16A according to the present invention having a fixed broad head and an extended shaft having blades in an open and locked position. These figures will be described in conjunction with one another.

Arrow 900*a* can include a shaft 901, an arrow shaft coupler 902, and an arrow shaft insert 903. Additionally, shaft 901 can include an insert, sleeve, or the like (not shown) that can be located within at least a portion of shaft 901. In one example, this sleeve (not shown) can be made of aluminum or other material selected for its high strength and relatively low weight. Arrow shaft coupler 902 and arrow shaft insert 903 can couple in a mating fashion. For example, arrow shaft coupler 902 can include a screw, fastener, clip, clasp, or the like for coupling the extended shaft 918 with arrow shaft 901. Additionally, insert 903 can include a channel, slot, or the like for receiving the coupler 902, such as, for example, female threads of a screw. In this example, the extended shaft 918 can be removeably coupled to and decoupled from arrow shaft 901 so that it can be easily interchanged and recoupled to arrow shaft 901. Through this interchangeability, the extended shaft 918 can be manufactured as a unit and made compatible with standard off-the-shelf arrow shafts. Alternatively, shaft 901 and extended shaft 918 can be manufactured as a unit adapted to receive standard-off-the shelf tip. Further, arrow shaft insert 903 can be implemented in manner such that it could be coupled with arrow shaft 901 in a similar manner as one would couple the arrow shaft 901 with a standard arrow head, such as a broad head.

In an alternative embodiment, the extended shaft 918 can be omitted and the remaining features (e.g., blades 906, 907, broad head tip 912, etc.) can be coupled to arrow shaft 901 without the need for extended shaft 918. In this example, rather than coupling coupler 902 to insert 903 of extended shaft 918, coupler 902 can be coupled directly to tip 912. As such, arrow 900*a* can be implemented and function in a manner identically as described below with regard to arrow 900*a* with the extended shaft 918, but without the need for extended shaft 918 because one or more of the components of extended shaft 918 can be coupled to arrow shaft 901 instead.

Additionally, arrow 900*a* can be implemented as a multiple-cut arrow. In this example, the front of shaft 901 (or extended shaft 918) can be configured to receive tip 912 forming a first cutting portion and one or more blades (e.g., 906, 907) in shaft 901 (or extended shaft 918) can form a second cutting portion. The second cutting portion can be located remote from the first cutting portion or, for example, behind insert 911 that can be designed to receive the first cutting portion or be disposed at some distance from the first cutting portion. Moreover, the second cutting portion can be offset form the plane of the blades on tip 912 to provide for a cutting area in addition to the cutting area of the one or more blades 906, 907.

In an exemplary and non-limiting illustrative embodiment, arrow shaft coupler 902 can couple with arrow shaft insert 903 to permit a portion of the shaft 901 (e.g., portion forward relative to the coupler 902 to move in a longitudinal direction either toward, or away from, the broad head tip 912 (e.g., a fixed broad head). In this embodiment, as arrow tip 912 impacts a target, arrow shaft 901 can move toward extended shaft 918 which, in turn, can facilitate with the deployment of blades 906, 907 in accordance with the description provided below. The extended shaft 918 can be embodied to include various lengths, for example, between two and twenty inches, although lengths greater than twenty inches and less than two inches are contemplated as well. can be Arrow shaft 901 and extended shaft 918 can be made of various materials, preferably materials with a high strength-to-weight ratio. For example, arrow shaft 901 and/or extended shaft 918 can be made of a high-impact polycarbonate material. In other examples, arrow shaft 901 and/or extended shaft 918 can be made of plastics, thermoplastic polymers, or other synthetic materials suitable for use in an archery-related activities. Other elements of arrow 900*a* can be made of polycarbonate material and/or plastics, thermoplastic polymers, or the like. In a non-limiting example, coupler 902, insert 903, cartridge 904, and insert 911 (as described in greater details below) can be made of one or more of these materials as well.

Extended shaft 918 (or the arrow shaft 901) can further include one or more blades 906, 907. One or more blades 906, 907 can include arrow blades and can be at least partially disposed within, or internal to, the extended shaft 918 (or the arrow shaft 901). In one example, the one or more blades 906, 907 can include at least one tab (illustrated, for example, as tabs 908 and 909 on blades 906 and 907, respectively). The at least one tabs 908, 909 can be designed to function as trigger blades such when the tabs 908 and 909 contact a target, the tabs 908 and 909 can assist in deploying blades 906, 907, respectively, as the arrow 900*a* (e.g., as illustrated in FIGS. 16A and 16B) penetrates the target. Tabs 908 and 909 can additionally provide support, strength, and facilitate in determining the final angle of blades 906, 907 when in the opened position.

In an exemplary and non-limiting illustrative embodiment, tabs 908, 909 can coupled to blades 906, 907, respectively, with couplers 927, 928 (for example, as shown in FIG. 16A). Couplers 927, 928 can include any pivot, hinge, pin, joint, or the like for allowing tabs 908, 909 to rotate with respect blades 906, 907. In one example, tabs 908, 909 can be made to be retractable such that they may pivot about blades 906, 907 between opened and closed positions. For example, when blades 906, 907 are in the closed position, tabs 908, 909 can rotate about blade 906, 907 at the point in which they are coupled to blades 906, 907 (e.g., couplers 927, 928, respectively) such that they are flush or substantially flush with extended shaft 918. As tip 912 impacts the target, arrow 900*a* will begin to decelerate, causing tabs 908, 909 to rotate outward about couplers 927, 928 relative to blades 906, 907 to catch the target and further assist with the deployment of blades 906, 907. In another example, these retractable-type tabs 908, 909 can be deployed mechanically as tip 912 impacts its target (e.g., by "catching" the target upon entry, and being forced open by the inertia of the arrow penetrating the target). This mechanical function can be performed, for example, in any manner similarly described for mechanically deploying arrow blades as the tip (e.g., tip 6 as illustrated in FIG. 2, tip 912 as illustrated in FIG. 16A, etc.) impacts a target. Additionally, tabs 908, 909 can be designed with a rounded cam back (or other various configurations) to help maximize their ability to catch the target upon impact as they rotate back toward cartridge 904.

Blades 906, 907 can be located anywhere along extended shaft 918 (e.g., between forward tip 912 and coupler 903), if an extended shaft is used, or anywhere along the shaft if the extended shaft is not used. Blades 906, 907 can further be coupled to extended shaft 918 such that one or more blades 906, 907 are flush or substantially flush with extended shaft 918. In one example, blades 906, 907 can omit tabs 908, 909 and remain flush or substantially flush with extended blade 918. In another example, blades 906, 907 can be fully flush with extended shaft 918 save tabs 908, 909 that can extend at least partially outside the outer diameter of extended shaft 918. Other examples, though not specifically illustrated in the figures, are contemplated as well. For example, arrow 900*a* can include more than two blades, multiple tabs, etc.

Arrow 900*a* can further include blade cartridge 904 and blade pin 905. Blade pin 905 can be disposed within slot 924 to further facilitate the deployment of blades 906, 907. For example, blades 906, 907 can be coupled to extended shaft 918 such that pin 905 engages in slot 924 of one or more blades 906, 907. In this example, as blades 906, 907 begin to deploy (for example, as shown in FIG. 16B), blades 906, 907 can rotate about extended shaft 918 and blades 906, 907 can slide in rearward direction relative to the tip 912 along slot 924 while being guided by pin 905.

Blade cartridge 904 can further assist in the deployment of blades 906, 907 in that cartridge 904 can be designed with a particular angle to assist in the deployment of the blades 906, 907. For example, as blades 906, 907 move in a rearward direction (e.g., upon the tip's 912 impact with a target), the trailing edges of the blades 906, 907 can contact the surface of cartridge 904 to assist in the speed and angle of deployment depending on the angle of the cartridge (e.g., the angle of the surfaces forward relative to tip 912). Additionally, the angle of cartridge 904 can help determine the final angle of the blades 906, 907 after they are deployed (for example, as illustrated in FIG. 16C). In one example, an indirect proportionality can exist between the angle of the cartridge surface (e.g., as measured between the two surfaces forward relative to tip 912) and the final angle of the blades 906, 907 (for example, as illustrated in FIG. 16C) as measured between the leading edges of blades 906, 907 (i.e., the greater the angle of the cartridge 904, the smaller the angle between the leading edges of blades 906, 907 in their final resting position once deployed). Additionally, blades 906, 907 can include one or protrusions 929, 930. Protrusions 929, 930 can any structure such a lip, flap, bump, flange, or the like for assisting in the opening of blades 906, 907. For example, as blades 906, 907 begin their deployment, protrusions 929, 930 can contact the leading edges of cartridge 904 such that protrusions 929, 930 can provide an additional resistive force (e.g., by pushing back against cartridge 904) to facilitate the opening of blades 906, 907.

Exemplary angles for cartridge 904 can include 45-degree and 60-degree angles, although other angles are contemplated as well. Additionally, cartridge 904 can be removably coupled to arrow 900*a* such that cartridges of varying shapes, sizes, and angles can be employed based on particular applications of the arrow 900*a*. Moreover, cartridge 904 can be adjustable such that its position and/or angle can be varied by the user. Cartridge 904 can extend forward to blades 906, 907 and a lock pin 925 (such as a mechanical locking pin or the like) can align itself or otherwise engage with one or more openings 926 (e.g., holes, cavities, or other slots, slits, or the like) of blades 906, 907 as they deploy.

In another example, the final angle of the blades 906, 907 can be determined by the configuration of the tabs 908, 909. For example, as blades 906, 907 deploy through a partially deployed configuration (as shown, for example, in FIG. 16B), through to a fully deployed configuration (as shown, for example, in FIG. 16C), tabs 908, 909 can contact the outer diameter of extended shaft 918. The contact between tabs 908, 909 and extended shaft 918 can additionally lock blades 906, 907 in place.

Arrow 900*a* can further include blade seal 910, such as an "o" ring, cover, coating, or other type of coupler or seal, such as, for example, shrink wrap. The blade seal 910 can be disposed around blades 906, 907 to prevent them from opening prematurely. As the arrow 900*a* decelerates, the blades 906, 907 can be forced outwardly relative to the extended shaft 918, thus breaking seal 910. In one example, a new seal 910 can be replaced every time the arrow blades 906, 907 are returned to their non-deployed positions. In another example, seal 910 can slide or "roll" off its position over blades 906, 907 (e.g., in a forward or reverse direction relative to the tip 912). In this example, the seal 910 can be rolled back to its position after the blades are returned to their closed position and used again for the next arrow shot.

Finally, arrow 900*a* can include a broad head tip insert 911. Insert 911 can include a coupler, such as a screw or the like for coupling broad head 912 to extended shaft 918. Insert 911 can be removably coupled to extended shaft 918 such that it can be interchangeable with one or more types of broad heads including, for example, off-the-shelf fixed broad head devices. Arrow 900*a* need not be limited to arrows such as those used with a bow. For example, arrow 900*a* can be embodied as a projectile for bows, crossbows, spear guns, dart guns, or the like. Similarly, arrows 900*b* and 900*c* (as described in greater details below) can be embodied more generically a projectiles to be used for bows, crossbows, spear guns, dart guns, etc. as well.

An example of the deployment described in FIGS. 16A-16C is described in greater detail below. As tip 912 impacts a target, the tip 912 and extended shaft 918 will continue through the target. As tabs 908, 909 impact the target, the tabs 908, 909 can catch a portion of the target, thus forcing the blades in rearward and outward direction (as shown, for example, in FIG. 16B). As the blades 906, 907 contact the target (e.g., the leading edge of the tabs 908, 909 can cause the blades 906, 907 to begin to deploy) the blades 906, 907 can continue to open inside the target until they reach their final resting position (as shown, for example, in FIG. 16C).

Additionally, as the arrow tip 912 strikes the target, the arrow 900*a* will begin to decelerate and blades 906, 907 can slide back toward cartridge 904. The rotation of the blades 906, 907 as they open can provide a torque perpendicular to the extended shaft 918. Although this deceleration can further assist with the deployment of blades 906, 907, a significant amount of the blades' 906, 907 deployment can occur while inside the intended target. This will maximize the transfer of kinetic energy into the target and further maximize the damage inflicted on the target.

Figure 17A:
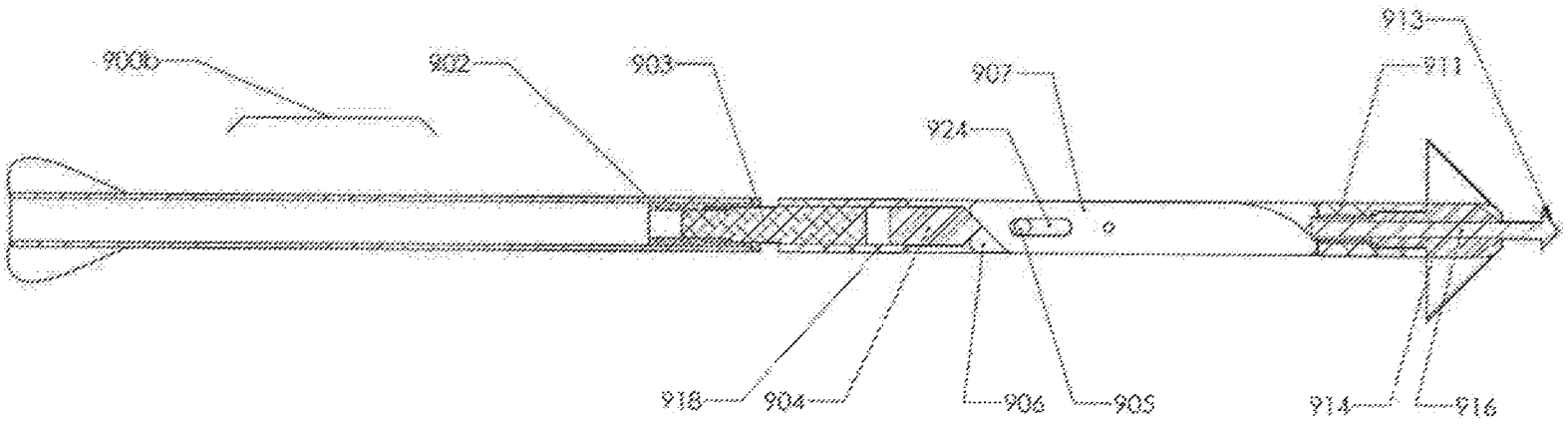
FIG. 17A is a cross-sectional view of a second embodiment of an arrow according to the present invention having a channeled broad head and an extended shaft with its blades in a closed position.
Figure 17B:
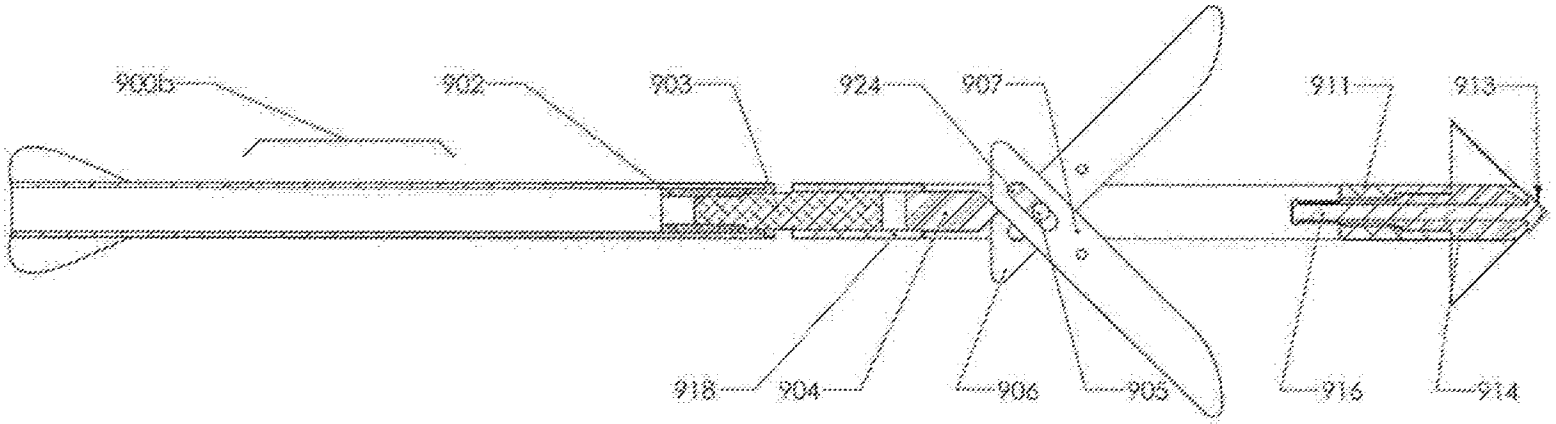
FIG. 17B is a cross-sectional view of a second embodiment of an arrow as illustrated in FIG. 17A according to the present invention having a channeled broad head and an extended shaft with its blades in a partially deployed position.
Figure 17C:
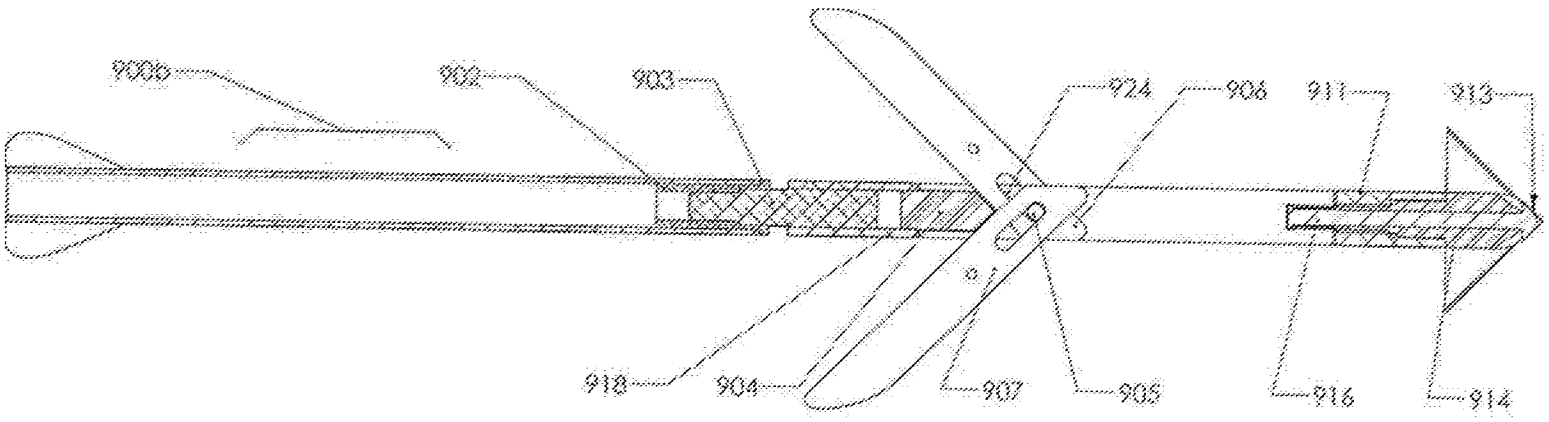
FIG. 17C is a cross-sectional view of a second embodiment of an arrow as illustrated in FIG. 17A according to the present invention having a channeled broad head and an extended shaft with its blades in an open and locked position.
Figure 18:
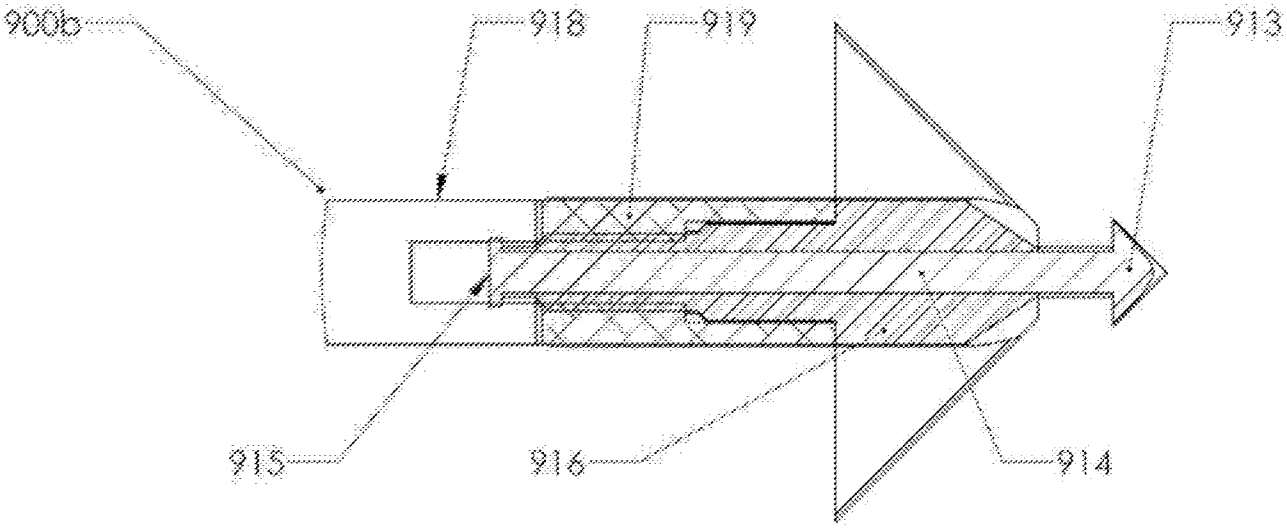
FIG. 18 is an enlarged cross-sectional view of the arrow according to FIGS. 17A-17C illustrating certain features according to the present invention.

FIG. 17A is a cross-sectional view of a second embodiment of an arrow according to the present invention having a channeled broad head and an extended shaft with its blades in a closed position. FIG. 17B is a cross-sectional view of a second embodiment of an arrow as illustrated in FIG. 17A according to the present invention having a channeled broad head and an extended shaft with its blades in a partially deployed position. FIG. 17C is a cross-sectional view of a second embodiment of an arrow as illustrated in FIG. 17A according to the present invention having a channeled broad head and an extended shaft with its blades in an open and locked position. FIG. 18 is an enlarged cross-sectional view of the arrow according to FIGS. 17A-17C illustrating certain features according to the present invention. These figures will be described in conjunction with one another.

Arrow 900*b* can include arrow shaft 901 and arrow shaft insert 902. These elements can be similarly embodied as arrow shaft 901 and arrow shaft insert 902 of arrow 900*a* as described in conjunction with FIGS. 16A-16C and, thus, will not be repeated here for the sake of clarity and brevity. Arrow 900*b* can further include a channeled broad head 916 that can be adapted to receive push rod 914 that can be coupled to adjustable tip 913. Adjustable tip 913 can be adapted to move in a longitudinal direction toward and away from channeled broad head 916.

Channeled broad head 916 can include a slot, channel, or other slit adapted to receive push rod 914 such that at least a portion of push rod 914 can pass through an inner portion of channeled broad head 916 to an outer surface of channeled broad head 916. As adjustable tip 913 impact a target, it can travel in a rearward direction toward channeled broad head 916. Because adjustable tip 913 can be rigidly coupled to push rod 914, this rearward movement can cause push rod 914 to travel toward blades 906, 907 thus forcing the blades 906, 907 to begin to deploy. Alternatively, a blade opening device 915 can be employed (as shown, for example in FIG. 18). In an exemplary and non-limiting illustrative embodiment, blade opening device 915 can include a screw head or the like such that as push rod 914 contacts blade opening device 915, blades 906, 907 can begin to deploy (as shown, for example, in FIG. 17B). Blades 906, 907 can continue to deploy as arrow 900*b* continues into its target until they reach their final resting position (as shown, for example, in FIG. 17C). Blade opening device 915 can include any structure, such as a knob, disk, etc. to be designed in such a manner such that it can be received by a cavity formed by the leading edges of blades 906, 907 while in the undeployed (e.g., closed) position to facilitate their opening as the blade opening device 915 contacts them.

Referring specifically to FIG. 18, arrow 900*b* can include insert 919 such that push rod 914 is adapted to travel through insert 919 and further to facilitate the motion of the push rod 914 in a forward and rearward direction relative to the adjustable tip 913, and minimize and/or eliminate motion of the push rod 914 in other directions (e.g., perpendicular to the direction of travel of the adjustable tip 913). Finally, although not depicted in this FIG. 18, arrow 900*b* can further include a seal 910 for holding blades 906, 907 in place until they deploy.

Figure 19A:
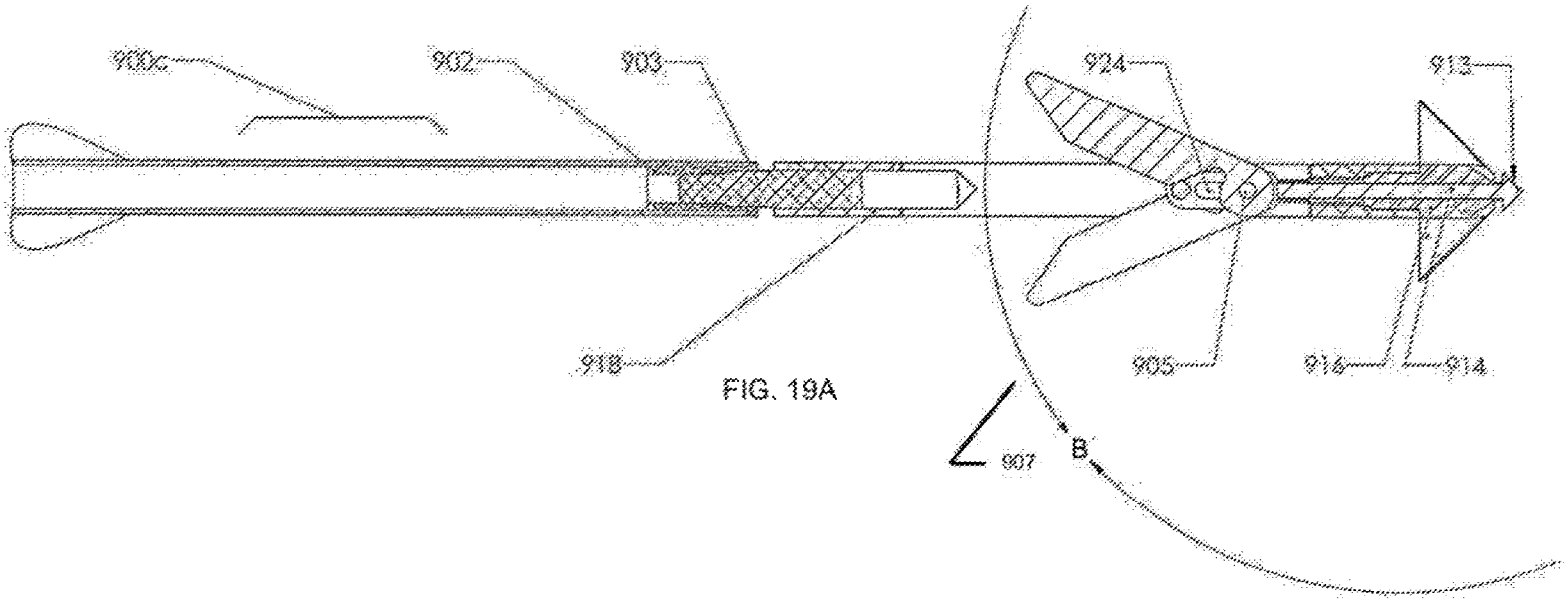
FIG. 19A is an enlarged cross-sectional view of a third embodiment of an arrow according to the present invention having a channeled broad head, a sliding tip, and an extended shaft with its bladed in the forward open position.
Figure 19B:
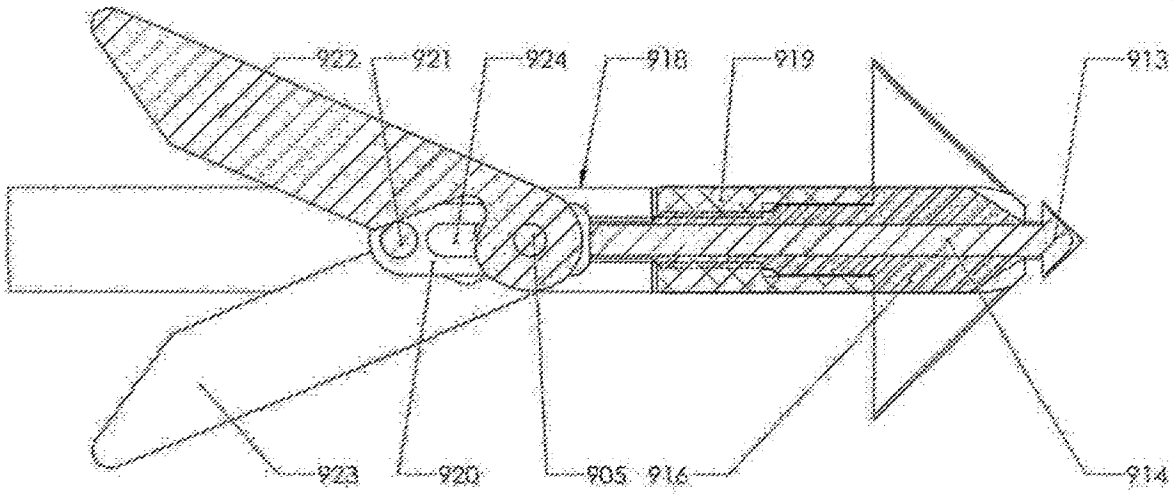
FIG. 19B is a close-up view of FIG. 19A.

FIGS. 19A and 19B illustrate an enlarged cross-sectional view of a third embodiment of an arrow according to the present invention having a channeled broad head, a sliding tip, and an extended shaft with its blades in the forward open position. Arrow 900*c* can include adjustable tip 913, push rod 914, a channeled broad head 916, an extended shaft 918, slot 924, and pin 905. These elements can be similarly embodied as similarly labeled elements of arrow 900*a* and/or arrow 900*b* as described in conjunction with FIGS. 16A-16C, 17A-C, and 18 and, thus, will not be repeated here for the sake of clarity and brevity.

Arrow 900*c* can further include blades 922, 923, a slide bar 920, and a slide bar opening device 921. As adjustable tip 913 impacts a target, it can be forced in a rearward direction toward channeled broad head 916 thus forcing push rod 914 toward slide bar 920. Slide bar 920 can be rigidly coupled to push bar 914 such that both slide bar 920 and push rod 914 can move as a single, monolithic unit. As slide bar 920 moves in a rearward direction relative to channeled broad head 916, slide bar opening device 921 can push blades 922, 923 outward with the facilitation of the slot 924 of blades 922, 923 and pin 905.

For example, as the blades deploy, blades 922, 923 can move rearward and outward along the channeled formed by slot 924 using pin 905 as a guide within slot 924. Slide bar opening device 921 can include any structure, such as a screw head, knob, disk, etc. to be designed in such a manner such that it can be received by a cavity formed by the blades 922, 923 while in the undeployed position to facilitate their opening as the slide bar opening device 921 contacts them. In one example, blades 922, 923 can be notched such that blade opening device 921 can contact notches in blades 922, 923 to facilitate their deployment.

While arrow designs have been has been illustrated and discussed in detail, the invention is not limited to those designs specifically shown. Modifications and adaptations of the above designs may occur to those skilled in the art. Such modifications and adaptations are in the spirit and scope of the invention as set forth herein.

What is claimed is:

1. A hunting apparatus, comprising:

an extended arrow shaft;

at least two arrow blades coupled to the extended shaft;

wherein the at least two arrow blades are substantially flush with the extended shaft in a closed position and the at least two arrow blades extend outward from the extended shaft in an opened position; and a multi-component blade coupler system associated with the at least two blades and configured to releasably couple the at least two blades together in the closed position wherein a first component of the multi-component coupler system is part of a first of the at least two blades, and wherein a second, different component of the multi-component coupler system is part of a second of the at least two blades.

2. The hunting apparatus of claim 1 further comprising a fixed broad head tip coupled to an end of the extended arrow shaft.

3. The hunting apparatus of claim 1, wherein the at least two blades travel radially outward from the extended shaft from the closed position to the opened position after the hunting apparatus contacts a target.

4. The hunting apparatus of claim 1 wherein the at least two arrow blades each comprise a tab that extends outside of the extended arrow shaft when the at least two blades are in the closed position.

5. The hunting apparatus of claim 1, wherein the first component of the multi-component coupler system is a pin, and wherein the second component of the multi-component coupler system is an opening.

6. The hunting apparatus of claim 5, further comprising a fixed broad head tip coupled to an end of the extended arrow shaft.

7. The hunting apparatus of claim 1, wherein the multi-component coupler system is configured to be overcome upon one or more of: deceleration of the extended arrow shaft, and the hunting apparatus contacting a target.

8. The hunting apparatus of claim 1, wherein the at least two blades move radially outward from the extended arrow shaft after the hunting apparatus contacts a target.

9. The hunting apparatus of claim 1, wherein the blades are configured to rotate out of the extended arrow shaft upon deceleration of the extended arrow shaft.

10. The hunting apparatus of claim 1, wherein each of the at least two blades comprise a tab that extends outside of the extended arrow shaft when the blades are in the closed position.

11. The hunting apparatus of claim 1, further comprising a structure within the extended arrow shaft configured to support the blades when they have rotated out of the extended arrow shaft.

12. The hunting apparatus of claim 1, wherein each blade comprises a tab, and the blades are configured to rotate out of the extended arrow shaft when the tabs contact a target.

13. The hunting apparatus of claim 1 wherein the second component of the multi-component coupler system comprises an opening.

14. An extended shaft blade system for an arrow shaft having a removable tip, the system comprising:

a cylindrical body having first and second ends, and an axial window extending through the body between the ends;

the first portion of the body configured to couple to an end of the arrow shaft;

a pair of blades configured to be housed within the window in a closed position;

each blade comprising a slot adjacent an end of the blade, the slot configured to cooperate with a pin associated with the window so that each blade may rotate about the pin outwardly from the window; and a coupler system formed by the pair of blades and configured to releasably couple the blades together in the closed position.

15. The system of claim 14, wherein a first portion of the coupler system is part of a first of the pair of blades, and wherein a second portion of the coupler system is part of a second of the pair of blades, and wherein the two portions cooperate to releasably couple the blades together in the closed position.

16. The system of claim 15, wherein the first portion of the coupler system is a pin, and wherein the second portion of the coupler system is an opening structurally configured to receive the pin.

17. The system of claim 14, wherein the system is configured so that the coupler system is overcome upon one or more of: deceleration of the body, and the system contacting a target.

18. The system of claim 14, further comprising a fixed broad head tip coupled to the second end of the cylindrical body.

19. The system of claim 14, wherein each blade comprises a tab that extends outside of the body when the blades are in the closed position.

20. The system of claim 14, further comprising a structure within the body configured to support the blades when they have rotated out of the window.

* * * * *